US006413689B1

(12) United States Patent
Hori et al.

(10) Patent No.: US 6,413,689 B1
(45) Date of Patent: Jul. 2, 2002

(54) POROUS PHOTOSENSITIVE BODY AND METHOD OF MANUFACTURING SAME

(75) Inventors: Takeshi Hori; Tsutomu Uezono; Tomoyuki Yoshii; Yasuhiro Funayama, all of Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/649,040

(22) Filed: Aug. 29, 2000

(30) Foreign Application Priority Data

Aug. 31, 1999 (JP) ..... 11-245754

(51) Int. Cl.[7] ..... G03G 5/04
(52) U.S. Cl. ..... 430/56; 430/127
(58) Field of Search ..... 430/68, 127, 132, 430/133; 399/237, 241, 159

(56) References Cited

U.S. PATENT DOCUMENTS

| | | | | |
|---|---|---|---|---|
| 3,776,630 A | * | 12/1973 | Ohno et al. | 430/68 |
| 4,157,260 A | * | 6/1979 | Kimura et al. | 430/68 |
| 4,232,104 A | * | 11/1980 | Shinozaki et al. | 430/68 |

FOREIGN PATENT DOCUMENTS

| | | |
|---|---|---|
| JP | 2606111 | 2/1997 |
| JP | 2897705 | 3/1999 |
| JP | 59-185-339 | 4/2000 |

* cited by examiner

*Primary Examiner*—John Goodrow
(74) *Attorney, Agent, or Firm*—Whitham, Curtis & Christofferson, PC

(57) ABSTRACT

A porous photosensitive body is provided which is excellent for mass production and lower in production costs and is capable of obtaining a good degree of image-formation and of increasing its productivity and reliability.

The porous photosensitive body is provided with a drum used for forming a photosensitive body constructed by stacking, in order, an insulating layer, a photo-conductive layer and a translucent conductive layer on an inner circumferential face of a surface electrode which is composed, of a metal jointless cylinder drum having a large number of fine holes which are aligned at equal intervals both in a circumferential direction and in a direction of an axial line of the cylindrical drum and are opened on inner and outer circumferential faces of the metal jointless cylinder and wherein the insulating layer is provided with a through hole communicating with each of the fine holes.

37 Claims, 19 Drawing Sheets

POROUS PHOTOSENSITIVE BODY AND METHOD OF MANUFACTURING SAME

BACKGROUND OF THE INVENTION

1. Field of the Invention

The present invention relates to a porous photosensitive body used for an image recording device such as a copying machine, facsimile, printer or a like and to a method for manufacturing same.

2. Description of the Related Art

As technology of forming an image, for example, in a copying machine, electronic printing technologies including a Carlson process (one of the xerographic methods) are known. In the Carlson process, since printing is made by six processes of charging, exposure, development, transfer, fixation and cleaning and since a unit is to be used specifically for each of the six processes is required, increased size of a printing device, generally, is unavoidable.

To solve this problem, electronic printing technology to substitute as the Carlson method has been disclosed by the applicant of the present invention in Japanese Patent Application Laid-open No. Hei9-204092. FIG. 19 is a perspective view showing configurations of a porous photosensitive body disclosed in the above patent application. As shown in FIG. 19, a porous photosensitive body 192 is composed of a large number of fine holes 191*a* opening on a surface of a layer and an insulating layer 191 having an electrode 191*b* exposed toward an outside which is stacked on a cylindrical body (not shown) used for forming the porous photosensitive body, wherein each of the fine holes 191*a* is filled with conductive coloring grains (toners) on which exposure light corresponding to printing information is irradiated to cause the photosensitive coloring grains to hop and to be selectively transferred through paper to be printed to an electrode 191*b* disposed in an opposed direction at a time of printing. A rotary axis 193 is provided with a flange 193*a* and is rotated in a main scanning direction "a" or in a sub-main scanning direction "b". By configuring the porous photosensitive body as above, the printing can be completed by three processes including filling with coloring grains, exposure and grain hopping and fixing, thus allowing a printing device to be made compact as a whole. Preferably, the porous photosensitive body is of a cylindrical shape or of a jointless sheet shape so that consecutive printing can be performed. Planar shape of the fine holes 191*a* can be round, elliptical, square or honeycomb, whichever may be selected as necessary.

In the porous photosensitive body of this type, to ensure a predetermined image density at the time of printing, a depth of each of the fine holes 191*a* constituting a minimum print unit (one dot), that is, a thickness of the insulating layer 191 is set so as to be comparatively large, while to ensure an image with high resolution, a pitch between two fine holes 191*a* being adjacent to each other is set to be as small as possible.

To fabricate the porous photosensitive body of this type, there is conventionally a method in which a sheet composed of an insulating body having the large number of fine holes 191*a* is wound around a circumferential face of the drum used to form the porous photosensitive body. However, in this method, a joint of the sheet is produced after the sheet is wound, which causes a defect in the image, resulting in reduction in quality of the printed image.

Moreover, there is another method for fabricating the porous photosensitive body of this type, in which, after insulating layers are formed on a circumferential face of a cylindrical drum for forming a photosensitive body, a large number of fine holes are made on an insulating body by using a laser or a drill. However, it is impossible to use this method practically, because only one hole can be made by a one time hole-making operation. For example, when printing with a resolution of 200 dots/inch is to be performed on A4 size paper, a million or more fine holes to be made on the insulating layer of the cylindrical drum with 210 mm in length and 30 mm in diameter are required. Though the large number of fine holes 191*a* can be made also by using the laser, thereby providing a high quality of printed images, is difficult to mass produce and is costly.

To handle these problems, a further method for fabricating the porous photosensitive body is proposed, in which an insulating layer made of a photo-curing liquid resin having cured and non-cured portions corresponding to hole patterns is stacked on a photo-conductive layer from which the non-cured portions have been removed. An insulating layer 201 is formed by such a method as shown in FIG. 20 which is a cross-sectional view of the conventional porous photosensitive body. That is, as shown in FIG. 20, a translucent conductive layer 203 and photo-conductive layer 204 are stacked, in consecutive order, on a circumferential face of a cylindrical translucent supporting body 202 and then a photo-curing liquid resin is coated on a circumferential face of the drum 205 (stacked body).

Moreover, as shown in FIG. 20, a pattern of a fine holes 201*a* of the insulating layer 201 is formed by irradiating exposure light along an axial direction while the drum 205 having the insulating layer 201 is being rotated at an angle θ corresponding to a hole pitch in a circumferential direction. Also, as shown in FIG. 20, the porous photosensitive body 206 is made of the drum 205 having the insulating layer 201 and 4 surface electrode 207.

However, the porous photosensitive body obtained by the methods described above has the following problems:

(1) Because the printing is made by irradiating exposure light from an exposure system (not shown) mounted in the cylindrical translucent supporting body 202, that is, the printing is made by a rear exposure printing method, the translucent supporting body 202 must be formed with high accuracy and therefore this method is not suitable for the mass production thereof.

(2) To achieve the printing with high resolution, it is necessary to perform a highly accurate alignment for a single line or several lines along the axial line of the cylindrical drum. This is because, unless the highly accurate alignment is performed, due to errors in angles occurring in one step being accumulated for each rotation of the drum at the time of exposure, a pitch between an exposure starting end and an exposure terminating end is not matched to one between fine holes 201*a* which causes a portion not to be exposed to be exposed and, due to curing of the resin in this portion, a line in which the fine hole 201*a* is not formed in the direction of the axial line of the drum, that is, a joint is produced. As a result, such additional devices as an angle detecting device, position detecting device or a like are required, which makes costs high.

(3) The fine hole 201*a* (FIG. 20) is formed, as shown by FIG. 21, by irradiating exposure light corresponding to a hole pattern on an photo-curing liquid resin 211, which constitutes the insulating layer 201 shown in FIG. 20, to cause a cured resin portion 211*a* and a non-cured resin portion 211*b* (a portion to produce a latent image) to be formed and then by removing the non-cured resin portion 211*b*. In this method, if exposure quantity is not adjusted, as shown in FIG. 22, a portion constituting the cured resin portion 211*a* is expanded due to halation of the transmitted light 212*a* reaching a groundwork layer 213 (photo-conductive layer 204 in FIG. 20) of the photo-curing liquid resin 211, causing the aperture portion of the fine hole 201*a* to be partially narrowed. FIG. 23 is a graph showing a relationship between exposure quantity and hardness of the photo-curing liquid resin 211 when the exposure light is irradiated on the insulating layer 201 of the conventional porous photosensitive body 206. As shown in FIG. 23, generally, in a sensitivity curve of the photo-curing liquid resin 211, as the exposure quantity increases, the hardness of the photo-curing liquid resin 211 increases and, after the exposure quantity exceeds a threshold value, the hardness of the photo-curing liquid resin 211 increases is saturated (it reaches a specified value), in many cases. However, if the halation does not occur from the groundwork layer 213, even when more of the exposure light 212 than is required is irradiated on the photo-curing liquid resin 211, the aperture portion of the fine hole 201*a* is not narrowed. Actually, due to the halation, the aperture portion of the fine hole 201*a* is partially narrowed, thus causing an unsatisfactory formation of the fine hole 201*a*. Because of this, the exposure by adjusting the exposure quantity (to an exposure quantity "a" in FIG. 23) is a good measure. However, a slope of a curve varies depending on types of photo-curing liquid resin to be used and, even in same types of the resin temperature conditions greatly influence viscosity of the photo-curing liquid resin or pot life of the photo-curing liquid resin. The slope of the curve varies depending on delicate changes in illuminance and/or wavelength caused by a quality of the exposure light 212 or a temperature of an exposure lamp. Therefore, the above adjustment of the exposure quantity required much time and causes a reduction in productivity.

(4) A proximity exposure method or projection exposure method is employed for irradiation of the exposure light on the photo-curing resin 211 to facilitate peeling of a mask after curing of the resin and to avoid defects in image at a time of peeling the mask. In these methods, the exposure light 212 is refracted due to a gap formed between a mask M (FIG. 21, FIG. 22) and photo-curing liquid resin 211 at the time of the exposure process, making it difficult to obtain an excellent degree of imageformation.

(5) Since the surface electrode 207 shown in FIG. 20 is formed by evaporation with metal or by printing of a metal paste on a surface of the insulating layer 201, its thickness is made thin and cannot be controlled so as to be uniform, causing an easy breakdown of the surface electrode 207 when used very frequently and causing its functional defects due to partial rise of a resistance (for example, because the fine hole 201*a* is not properly filled with the conductive coloring grains), thus resulting in reduction of reliability for use.

Other conventional porous photosensitive bodies are disclosed in Japanese Patent Application Laid-open No. Sho53-138734 and No. Sho59-185339, in which, "as shown in FIG. 24, after an insulating layer 242 and conductive layer for biasing 243 are stacked on a conductive screen base body 241, a photo-conductive layer 244 is stacked on the stacked body composed of the insulating layer 242 and conductive layer 243 and the conductive screen base body 241 by using a spray method" and therefore the problems described above remains unsolved by technologies described above.

SUMMARY OF THE INVENTION

In view of the above, it is an object of the present invention to provide a porous photosensitive body being excellent for mass production and lower in production costs and capable of obtaining a good degree of image-formation and of increasing its productivity and reliability.

According to a first aspect of the present invention, there is provided a porous photosensitive body including:

a drum for forming the porous photosensitive body constructed by stacking, in order, an insulating layer, a photo-conductive layer and a translucent conductive layer on an inner circumferential face of a supporting cylinder; and whereby the supporting cylinder is composed of a metal jointless cylinder having a large number of fine holes which are aligned at equal intervals both in a circumferential direction of the drum and in a direction of an axial line of the drum and are opened on inner and outer circumferential faces of the metal jointless cylinder and wherein the insulating layer is provided with a through hole communicating with each of the fine holes made on the metal jointless cylinder.

In the foregoing, a preferable mode is one wherein the supporting cylinder is composed of the jointless cylinder having a Vickers hardness of 50 to 1500.

By configuring as above, the supporting cylinder having enough mechanical strength to be used as a supporting body of the drum for forming the porous photosensitive body.

Also, a preferable mode is one wherein the supporting cylinder is made of the metal jointless cylinder containing nickel.

By configuring as above, the supporting body having enough corrosion resistance to be used as the supporting body can be obtained.

Also, a preferable mode is one wherein the insulating layer is made of an organic photosensitive resin.

By configuring as above, freedom to choose materials for the insulating layer is increased more when compared with a case where an inorganic photosensitive resin is used at a time of selection of materials.

Furthermore, a preferable mode is one wherein the photosensitive resin is made of a positive type photoresist. In this method, therefore, when the organic photosensitive resin is exposed, an exposed portion of the organic photosensitive resin is dissolved by a liquid developer.

According to a second aspect of the present invention, there is provided a method for manufacturing a porous photosensitive body having a drum for forming the porous photosensitive body constructed by stacking, in order, an insulating layer, a photo-conductive layer and a translucent conductive layer on an inner circumferential face of a supporting cylinder including steps of:

forming the supporting cylinder composed of a metal jointless cylinder having a large number of fine holes which are aligned at equal intervals both in a circumferential direction of the drum and in a direction of an axial line of the drum and are opened on inner and outer circumferential faces of the metal jointless cylinder; and forming a through hole communicating with each of the fine holes before the photo-conductive layer is stacked.

According to a third aspect of the present invention, there is provided a method for manufacturing a porous photosensitive body having a drum for forming the porous photosensitive body constructed by stacking, in order, an insulating layer, a photo-conductive layer and a translucent conductive layer on an inner circumferential face of a supporting cylinder including steps of:

forming the supporting cylinder composed of a metal jointless cylinder having a large number of fine holes which are aligned at equal intervals both in a circumferential direction of the drum and in a direction of an axial line of the drum and are opened on inner and outer circumferential faces of the metal jointless cylinder; and forming a through hole communicating with each of the fine holes after the photo-conductive layer is stacked.

According to a fourth aspect of the present invention, there is provided a method for manufacturing a porous photosensitive body having a drum for forming a photosensitive body constructed by stacking, in order, an insulating layer, a photo-conductive layer and a translucent conductive layer on an inner circumferential face of a supporting cylinder including steps of:

forming the supporting cylinder composed of a metal jointless cylinder having a large number of fine holes which are aligned at equal intervals both in a circumferential direction of the drum and in a direction of an axial line of the drum and are opened on inner and outer circumferential faces of the metal jointless cylinder; and forming a through hole communicating with each of the fine holes after the translucent conductive layer is stacked.

In the foregoing, it is preferable that the supporting cylinder is formed by an electroplating method.

By configuring as above, the supporting cylinder having enough thickness of the supporting cylinder to be used as a surface electrode can be obtained.

Also, it is preferable that the insulating layer is made of a photosensitive resin and the fine holes are made by irradiating exposure light on the photosensitive resin to dissolve an irradiated portion.

Also, it is preferable that the irradiating exposure light is irradiated on the insulating layer through the supporting cylinder. In this method, therefore, the supporting cylinder is used as a mask at a time of exposure and the irradiating exposure light is irradiated through this mask.

Also, it is preferable that the irradiating exposure light from a mercury lamp is irradiated on the insulating layer. In this method, therefore, the supporting cylinder is used as the mask and the irradiating exposure light from the mercury lamp is irradiated through this mask.

Also, it is preferable that the irradiated portion is dissolved by dipping a stacked body formed by stacking the insulating layer on the inner circumferential face of the supporting cylinder in a solvent. In this method, therefore, when the stacked body is dipped into a solvent after the irradiating exposure light is irradiated on the insulating layer, the irradiated portion of the insulating layer is dissolved and becomes the fine hole.

Also, it is preferable that the irradiated portion is dissolved by spraying the solvent on the insulating layer. In this method, therefore, when the solvent is sprayed after the irradiating exposure light is irradiated on the insulating layer, the irradiated portion of the insulating layer is dissolved and becomes the fine hole.

Also, it is preferable that the insulating layer or the photo-conductive layer is stacked by dipping each body to be stacked into a resin material. In this method, therefore, when the supporting cylinder is dipped in the resin material, the insulating layer is stacked and when the stacked body is dipped in the resin material, the photo-conductive layer is stacked onto the insulating layer and then onto the supporting cylinder.

Also, it is preferable that the insulating layer or the photo-conductive layer is stacked by applying the resin material to each body to be stacked and then by rotating each body to be stacked. In this method, therefore, when the supporting cylinder coated with the resin material for forming the insulating layer, the insulating layer is stacked onto the supporting cylinder and when the stacked body formed by coating the insulating layer with the resin material for forming the photo-conductive layer is rotated, the photo-conductive layer is stacked through the insulating layer onto the supporting cylinder.

Also, it is preferable that baking treatment is performed on each resin material when the insulating layer or the photo-conductive layer is stacked. In this method, therefore, the insulating layer or photo-conductive layer is stacked, in a state where the insulating layer or photo-conductive layer is solidified by baking them on each resin material, on each body to be stacked.

Also, it is preferable that a surface of the supporting cylinder is coated when the insulating layer or the photo-conductive layer is stacked.

By configuring as above, adhesion of the resin material to the surface of the supporting cylinder can be prevented when the insulating layer or photo-conductive layer is stacked.

Furthermore, it is preferable that the translucent conductive layer is stacked by applying a liquid material to an inner circumferential face of the photo-conductive layer and by curing. In this method, therefore, the translucent conductive layer is obtained in a state where liquid resin is applied to the inner circumferential face of the photo-conductive layer and is cured.

BRIEF DESCRIPTION OF THE DRAWINGS

The above and other objects, advantages and features of the present invention will be more apparent from the following description taken in conjunction with the accompanying drawings in which.

DETAILED DESCRIPTION OF THE PREFERRED EMBODIMENTS

Best modes of carrying out the present invention will be described in further detail using various embodiments with reference to the accompanying drawings.

EMBODIMENT

Figure 1A:
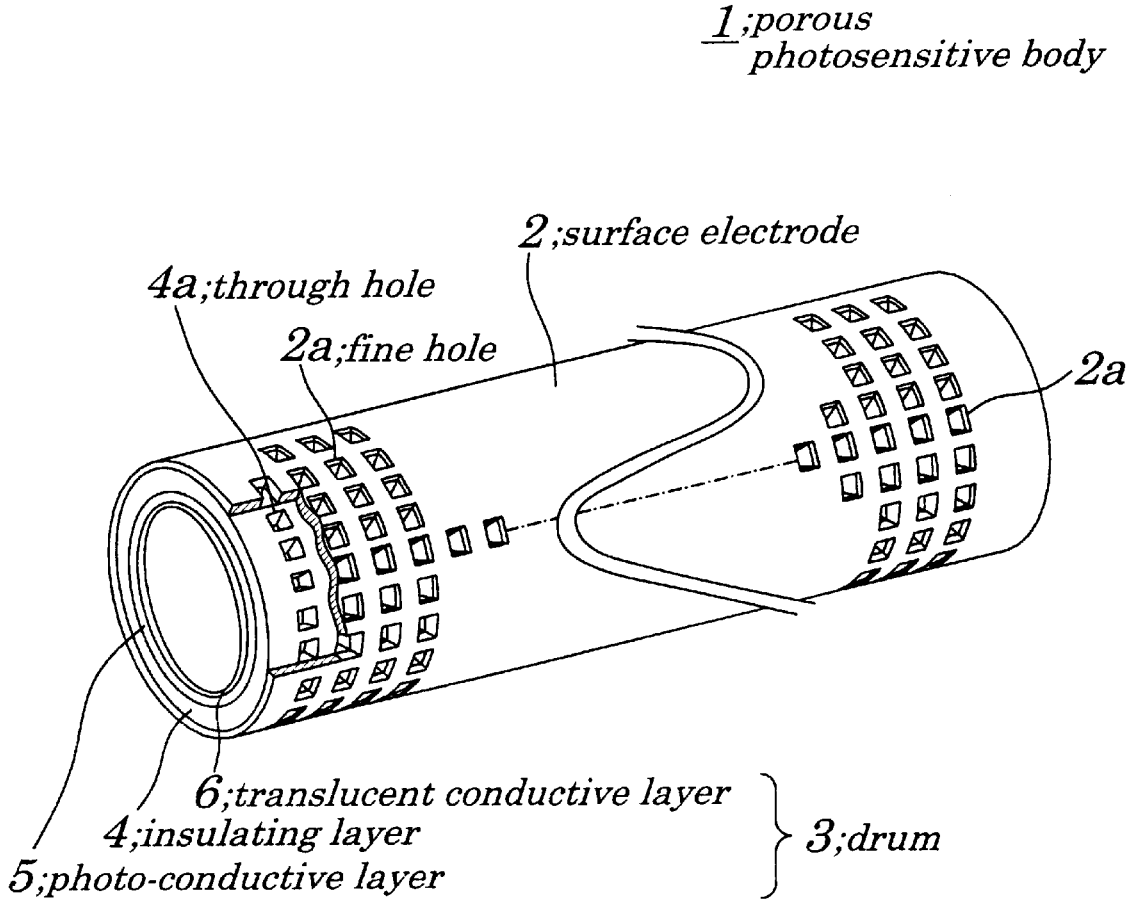
FIGS. 1A and 1B are a perspective view and a cross-sectional view, respectively, of a porous photosensitive body according to an embodiment of the present invention.
Figure 1B:
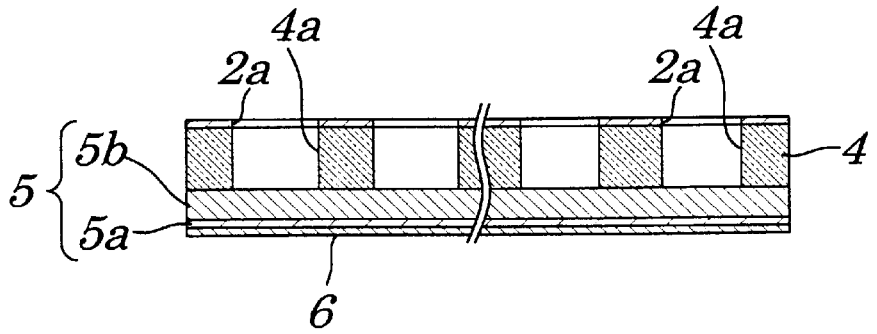

FIGS. 1A and 1B are a perspective view and a cross-sectional view, respectively, of a porous photosensitive body 1 according to an embodiment of the present invention. The porous photosensitive body 1 is composed of a surface electrode 2 and a cylindrical drum 3. The surface electrode 2 has a large number of fine holes 2*a* which are aligned at equal intervals in a circumferential direction and in a direction of an axial line of the cylindrical drum 3 and are opened at, a circumferential face of the cylindrical drum 3. The surface electrode 2 entirely contains components of metal including nickel and is made of a jointless (endless) cylindrical metal mesh sleeve mounted in a circumferential direction thereof. The surface electrode 2 is so structured that its Vickers hardness (Hv) is within a range of 50 to 1500 (preferably 100 to 1200) and that its thickness is within a range of 20 $\mu$m to 100 $\mu$m.

Since a pitch among the fine holes 2*a*, a planar shape of an aperture portion and an aperture rate (an area ratio of an aperture) almost conform to those in an insulating layer 4 (described later), a pitch of a mesh on the surface electrode 2 must be so fine as to provide high resolution required in the porous photosensitive body 1.

The surface electrode 2 functions as a mask when a hole pattern is formed on the insulating layer 4. The surface electrode 2, while printing is made, has a function of serving as a supporting body, of producing high electric fields in a photo-conductive layer 5, of trapping conductive (coloring) grains in fine holes of the insulating layer 4 and of preventing the conductive grains from adhering to the surface electrode 2.

The cylindrical drum 3 is made of the insulating layer 4, photo-conductive layer 5 and a translucent conductive layer 6. The cylindrical drum 3 is formed in a manner that the insulating layer 4, the photo-conductive layer 5 and the translucent conductive layer 6, each having a predetermined thickness, are stacked, in order, on an internal circumferential face of the surface electrode 2. The insulating layer 4 has a through hole 4*a* communicating with each of the fine holes 2*a* on the surface electrode 2 and is stacked on the inner circumferential face of the surface electrode 2. The insulating layer 4 is so constructed that its thickness is about 100 $\mu$m and all of the insulating layer 4 is made of an organic positive photosensitive resin.

As shown in FIG. 1B, the photo-conductive layer 5 has a charge generating layer 5*a* and a charge transferring layer 5*b* and is stacked on the inner circumferential face of the insulating layer 4 in a manner that it narrows the through hole 4*a*. The photo-conductive layer 5 is made entirely of inorganic materials or organic materials. The charge generating layer 5*a* is so structured that its thickness is about 0.05 $\mu$m to 1 $\mu$m. The charge transferring layer 5*b* is so structured that its thickness is about 1 $\mu$m to 30 $\mu$m (preferably 5 $\mu$m to 25 $\mu$m). To form the photo-conductive layer 5 made of organic materials, a dip coating method is employed (hereinafter a description is made provided that the photo-conductive layer 5 is made of organic materials). When an image is to be printed, if exposure light corresponding to print information is irradiated on the photo-conductive layer 5, an electric charge corresponding to an amount of exposure light is generated from the charge generating layer 5*a*. On the other hand, the charge transferring layer 5*b* transfers the electric charge generated by the charge generating layer *a* to a surface of the photo-conductive layer 5 to neutralize a counter charge existing on the surface of the photo-conductive layer 5 being charged with electricity being opposite in polarity to the generated charge and to cause the generated charge to disappear.

The translucent conductive layer 6 is stacked on the inner circumferential face of the photo-conductive layer 5 and is entirely composed of ITO(Indium-Tin-Oxide) or $SnO_2$(tin dioxide) conductive materials. Methods including vacuum deposition, sputtering, dip coating, spray coating or a like are employed for formation of the translucent conductive layer 6.

Figure 2:
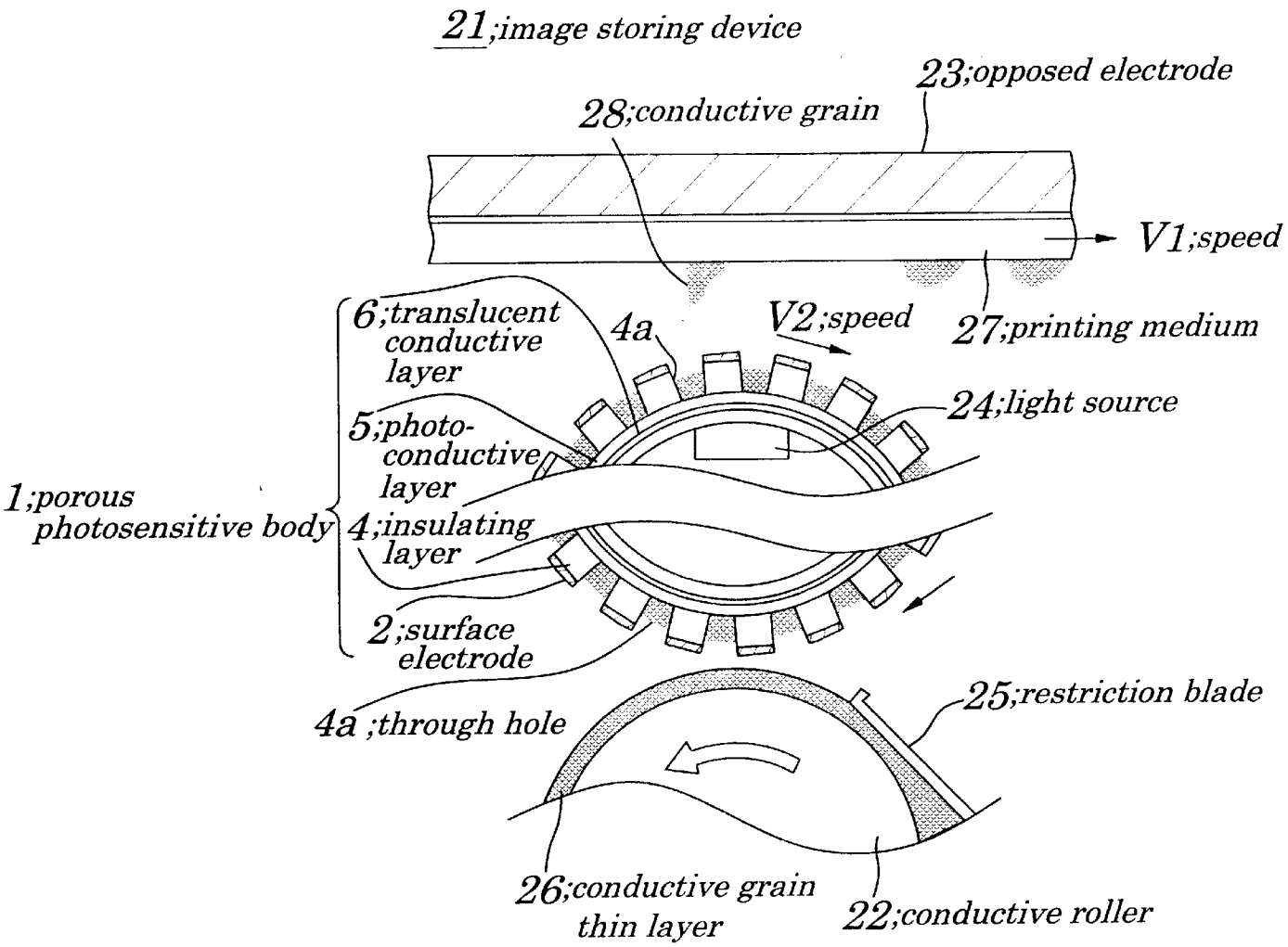
FIG. 2 is a cross-sectional view of an image recording device using a porous photosensitive body according to the embodiment of the present invention.

Configurations of an image recording device using the porous photosensitive body 1 structured as described above are explained by referring to FIG. 2, which is a cross-sectional view of an image recording device 21 using the porous photosensitive body 1 according to the first embodiment of the present invention. In FIG. 2 and subsequent figures, same components as described in FIG. 1 are assigned same reference numbers given in FIG. 1 and detailed descriptions are omitted accordingly.

In FIG. 2, the image recording device 21 is provided with the porous photosensitive body 1, a conductive roller 22, an opposed electrode 23, a light source 24 and a controller (not shown).

The porous photosensitive body 1 is held on a shaft (not shown) through a flange (not shown) in a manner that it can be rotated freely. The porous photosensitive body 1 rotates at a speed of V2 in an arrow direction as shown. The conductive roller 22 has a conductive grain thin layer 26 which is thinly layered by a restriction blade 25 and is mounted on an upstream side of the porous photosensitive body 1. The opposed electrode 23 is mounted on a downstream side of the porous photosensitive body 1. A storage medium 27 is mounted on a porous photosensitive side of the opposed electrode 23. The printing medium 27 is transferred at a speed of V1 in an arrow direction as shown by a transferring device (not shown) when an image is printed. The light source 24 is mounted within the porous photosensitive body 1.

The controller (not shown) is adapted to control a ratio of the speed V1 for transferring printing paper (printing medium 27) to a circumferential speed of the porous photosensitive body 1 and is mounted in vicinity of the porous photosensitive body 1 and the opposed electrode 23. This allows an image output having a same resolution both in a main scanning and a sub-main scanning directions and a print well balanced both in longitudinal and vertical directions to the printing medium 27 to be obtained when the image is printed.

A conductive grain 28 flies from the through hole 4*a* of the porous photosensitive body 1 (the insulating layer 4), when the image is printed, and adheres to the printing medium 27.

Operations of printing images of the image recording device 21 structured as above are described below.

First, by applying a voltage between the translucent conductive layer 6 and surface electrode 2 and between the surface electrode 2 and conductive roller 22, an electric field is produced between the translucent conductive layer 6 and conductive roller 22. At this point, the conductive grain 28 on the conductive roller 22 is charged with induced electricity being negative in polarity and is put into an aperture (the through hole 4*a*) of the porous photosensitive body 1. The conductive grain 28 which has collided with the surface electrode 2 is charged with electricity being positive in polarity and returns back to the conductive roller 22. Because of this, the conductive grain 28 is allowed to enter only the through hole 4*a* so that its potential is equal to that of the surface electrode 2. Since the electric field on a surface of a grain layer approaches zero, the conductive grain 28 is trapped in the through hole 4*a*.

Then, at printing section, the electric field coming from the translucent conductive layer 6 to the opposed electrode 23 is generated and light corresponding to the image is irradiated on the photo-conductive layer 5 from the light source 24. At this point, conductivity of an irradiated portion in the photo-conductive layer 5 becomes large and the charge of the conductive grain 28 within the through hole 4*a* leaks through the photo-conductive layer 5. Since a potential of the conductive grain 28 within the through hole 4*a* approaches a potential of the translucent conductive layer 6, the electric field is produced on a layer surface of the conductive grain 28 and the conductive grain 28 on the surface electrode side is charged with electricity being positive in polarity, flies from the through hole 4*a* and adheres to the printing medium 27. Thus, the printing of the image on the printing medium 27 can be implemented.

Since image density depends directly on the pitch between holes of the through holes 4*a* and a diameter of a same, in order to obtain high density of the printed image, it is desirous to optimize shape and alignment of the through hole 4*a* by setting the pitch to be as small as possible and hole diameter to be large. Moreover, to effectively perform the printing on the printing medium 27, it is also desirous to form the image on the cylindrical porous photosensitive body 1 and to consecutively proceed the printing process by, rotating the porous photosensitive body 1.

A method for manufacturing the porous photosensitive body 1 according to the embodiment of the present invention will be hereinafter described by referring to FIGS. 3A to FIG. 18.

The porous photosensitive body 1 of the embodiment is manufactured in a manner that the surface electrode 2 is first formed (formation of the surface electrode 2) and, after the insulating layer 4 is stacked on the inner circumferential face of the surface electrode 2 (formation of the insulating layer, 4), holes are made in the insulating layer 4 (hole-making in the insulating layer 4) and then the photo-conductive layer 5 and translucent conductive layer 6 are, in order, stacked on the inner circumferential face of the insulating layer 4 having the hole (formation of the photo-conductive layer 5 and translucent conductive layer 6). These processes are hereafter described in order.

Formation of Surface Electrode

Figure 3A:
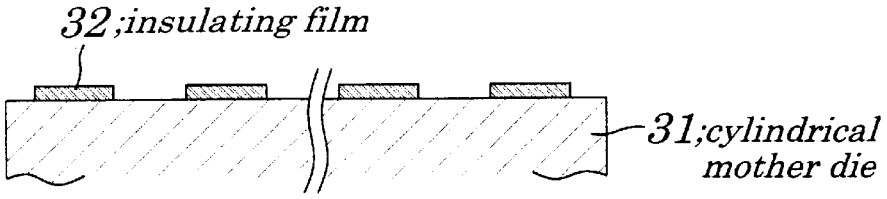
FIGS. 3A to 3D are cross-sectional views of a part of the porous photosensitive body explaining a method of manufacturing the porous photosensitive body according to the embodiment of the present invention.

FIGS. 3A to 3D are cross-sectional views of a part of the porous photosensitive body 1 explaining method of manufacturing the porous photosensitive body 1 of the embodiment. As shown in FIG. 3A, a photoresist pattern of an insulating film 32 is first formed at a portion corresponding to the fine hole 2*a* (shown in FIG. 4) on the surface electrode 2 along an outer circumferential face of a cylindrical mother die 31 made of a stainless steel having conductivity. An outer diameter of the cylindrical mother die 31 is almost equal to an inner diameter of a metal mesh sleeve 33 (described later). A surface of the cylindrical mother die 31 is worked with high accuracy to obtain excellent transferability when electroplating is performed.

Figure 3B:
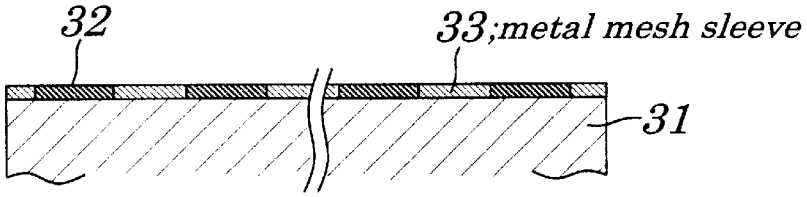

Next, as shown in FIG. 3B, by making metal deposited on the outer circumferential face of the cylindrical mother die 31 at a portion other than places where the insulating film 32 is formed, the metal mesh sleeve 33 with a thickness of 20 $\mu$m to 100 $\mu$m having no joint in a circumferential direction is formed.

As a material for the metal mesh sleeve 33, copper, iron, nickel, silver, gold or a like is used and, in the embodiment, nickel is used because of its excellent corrosion resistance. Hardness of the metal mesh sleeve 33 is set within a Vickers hardness (Hv) of 50 to 1500 (preferably 1000 to 1200).

Figure 3C:
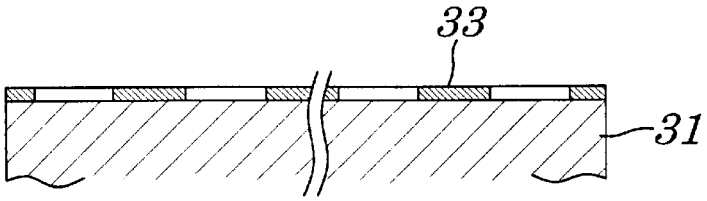
Figure 3D:
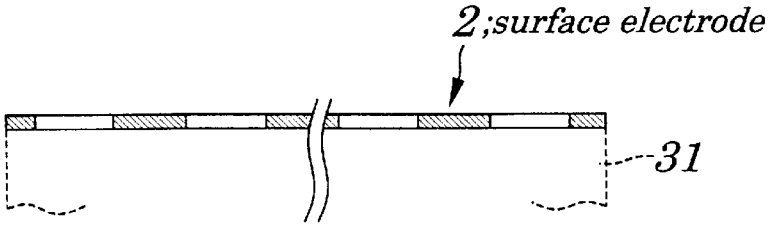
Figure 4:
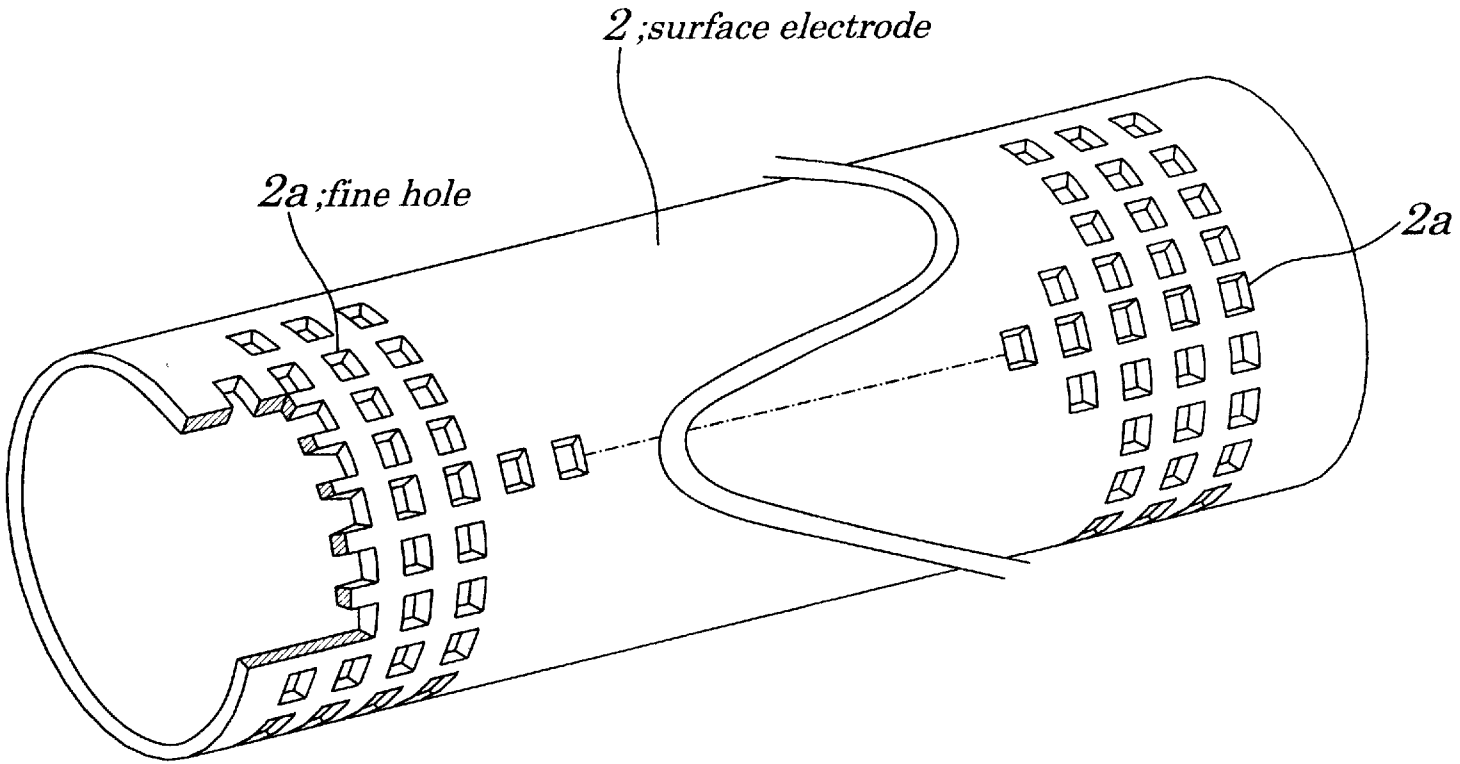
FIG. 4 is a perspective view of a surface electrode of the porous photosensitive body according to the embodiment of the present invention.

Next, after the insulating film 32 is dissolved and removed, as shown in FIG. 3C, by dipping the cylindrical mother die 31 on which the metal mesh sleeve 33 has been formed, into, for example, an organic solvent, the surface electrode 2 is formed, as shown in FIG. 3D and FIG. 4, by separating the cylindrical mother die 31 from the metal mesh sleeve 33.

Figure 5:
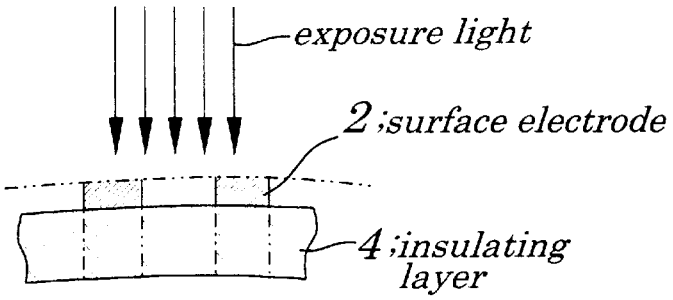
FIG. 5 is a cross-sectional view explaining a hole-making process (exposure process) for the porous photosensitive body according to the embodiment of the present invention.

Therefore, according to the method of forming the surface electrode 2 of the embodiment, it is possible to obtain the surface electrode 2 having a uniform and sufficient thickness and being free from defects, thus providing excellent conductivity and surely preventing occurrence of breakage of lines. Moreover, as shown in FIG. 5, the surface electrode 2 of the embodiment can serve as a mask for formation of hole pattern when the porous photosensitive body 1 is formed, that is, when it is exposed, in a state in which the surface electrode 2 is adhered firmly on photosensitive resin (insulating layer 4).

Furthermore, according to the embodiment, since the surface electrode 2 can be used as a supporting body at a time of manufacturing the porous photosensitive body 1, the translucent supporting body that had been conventionally required is not required. According to the embodiment, even in the case where the translucent supporting body is used, freedom to choose materials for the translucent supporting body is increased, thus providing a cost advantage.

Figure 6A:
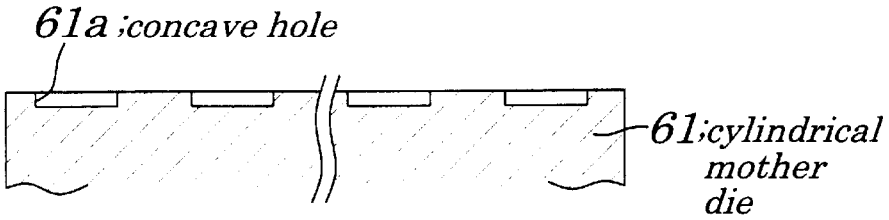
FIGS. 6A to 6D are cross-sectional views explaining another method for forming the surface electrode of the porous photosensitive body according to the embodiment of the present invention.
Figure 6B:
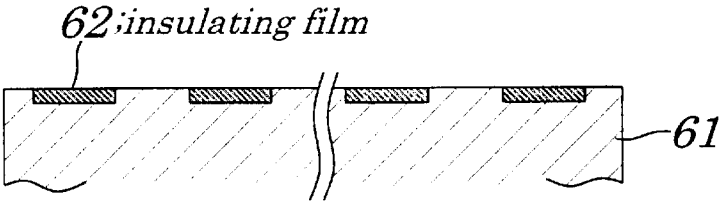
Figure 6C:
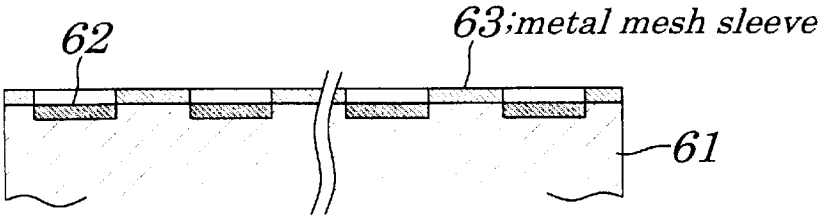
Figure 6D:
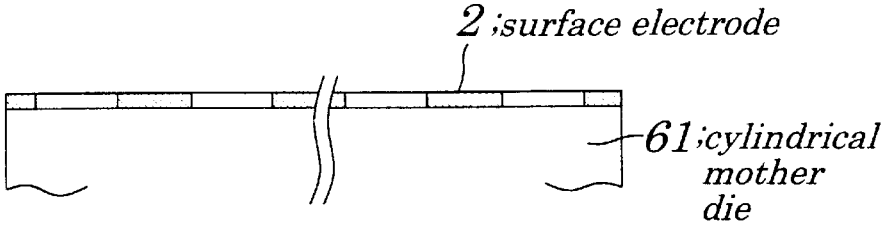

In the embodiment described above, the insulating film 32 is formed on the outer circumferential face of the cylindrical mother die 31 by photolithography, however, the present invention is not limited to this method. The following method is available. That is, as shown in FIG. 6A, a pattern of a concave hole 61*a* adapted to correspond to the fine hole 2*a* is first formed by carving or a like on the circumferential face of a cylindrical mother die 61. Next, after a insulating film 62 is embedded in the concave hole 61*a* as shown in FIG. 6B, a metal mesh sleeve 63 is formed by electroplating as shown in FIG. 6C and then the surface electrode 2 is formed as shown in FIG. 6D. In the method, since the photoresist pattern for every formation of the sleeve is not required, the method is suitable for mass production of the metal mesh sleeve 63.

Formation of Insulating Layer

Figure 7A:
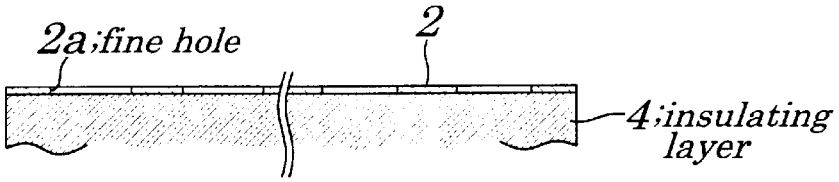
FIGS. 7A to 7F are cross-sectional views explaining the method for manufacturing the porous photosensitive body according to the embodiment of the present invention.
Figure 8:
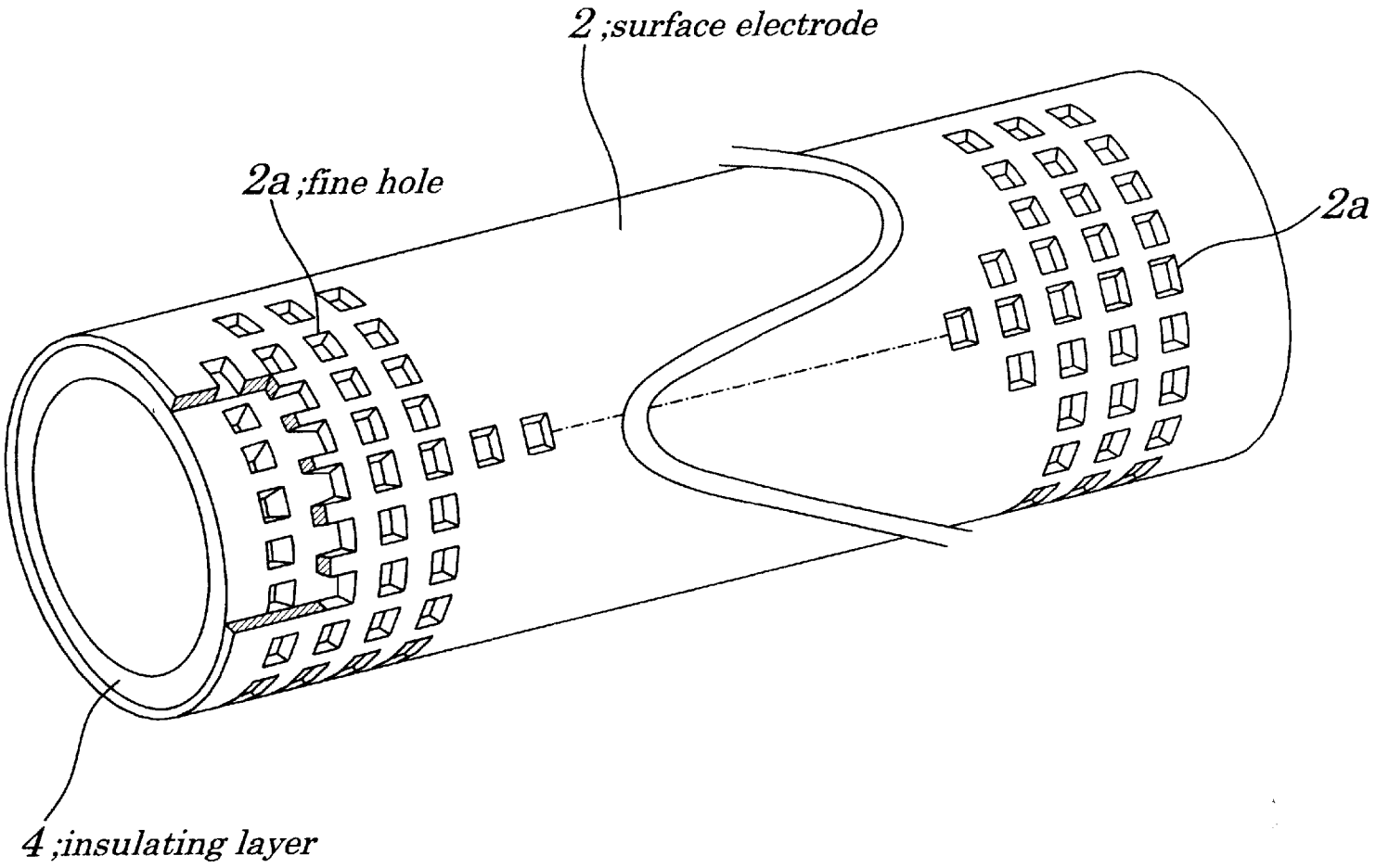
FIG. 8 is a perspective view showing a stacked state of an insulating layer on the surface electrode in the porous photosensitive body according to the embodiment of the present invention.

As shown in FIGS. 7A and 8, the insulating layer 4 is formed through formation of an organic positive photoresist pattern with a predetermined thickness (about 100 $\mu$m) on the inner circumferential face of the surface electrode 2.

In the above embodiment, a "PMER" (trade name, photoresist for plating use manufactured by Tokyo Ohka Kogyo Co., Ltd.) resin is used as a positive photoresist. However, the positive photoresist obtained by mixing a product obtained by condensing an alkali-soluble Novorak resin containing a photosensitive component such as phenol, cresol, xylenol or a like and aldehydes such as formaldehyde or a like in a presence of an acid catalyst, with a quinonediazido group containing compound, naphthoquinone-1,2-diazido sulfonic ester of aromatic polyhydroxy compound, in particular, serving as a photosensitive component may be used as well.

Figure 9:
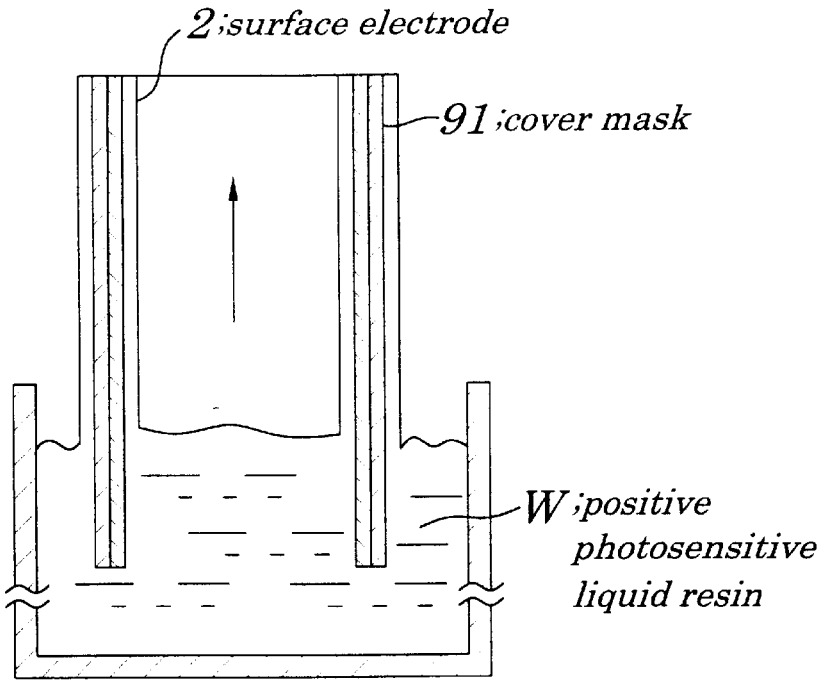
FIG. 9 is a perspective view explaining one method of forming the insulating body in the porous photosensitive body according to the embodiment of the present invention.
Figure 10:
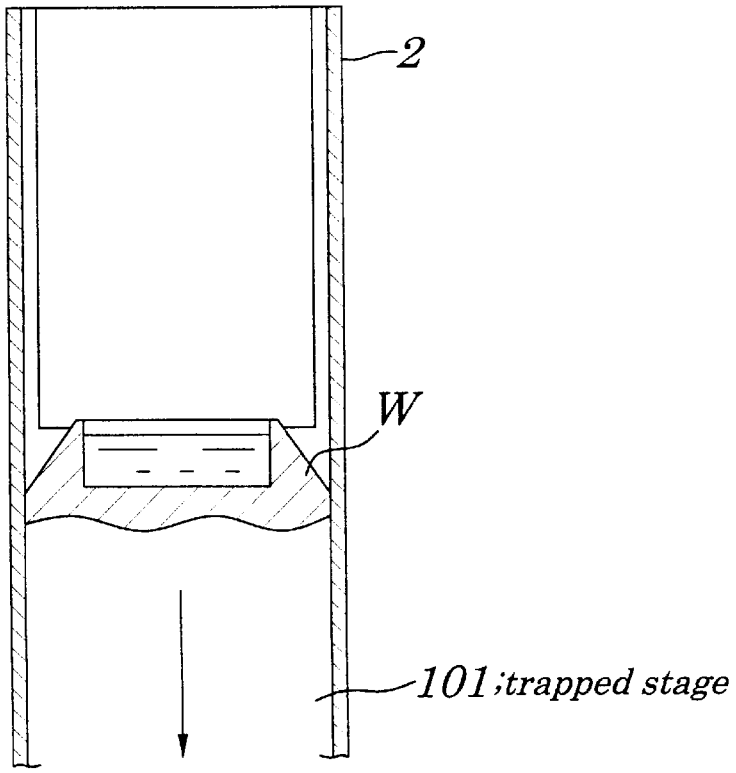
FIG. 10 is a perspective view explaining another method of forming the insulating body in the porous photosensitive body according to the embodiment of the present invention.
Figure 11:
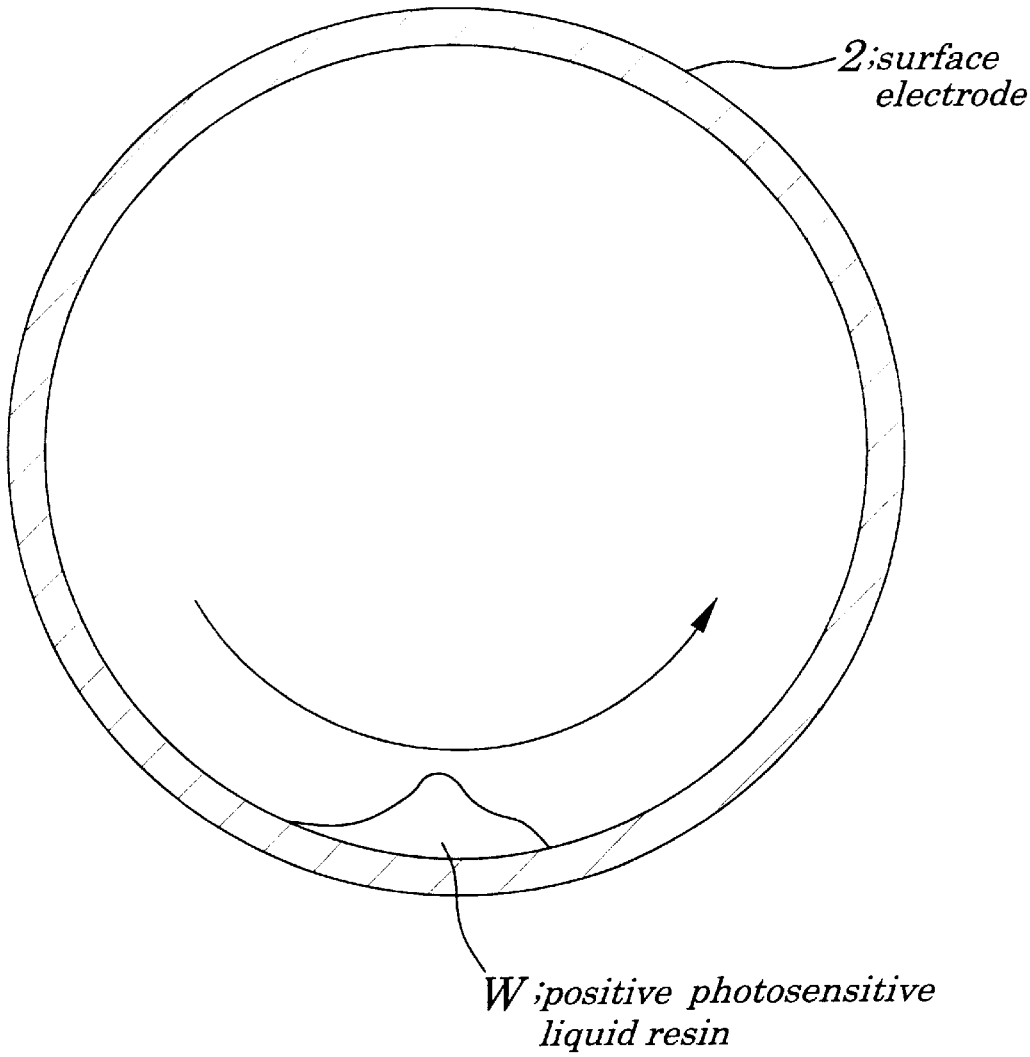
FIG. 11 is a perspective view explaining a third method of forming the insulating body in the porous photosensitive body according to the embodiment of the present invention.

In order to make a uniform number of conductive coloring grains in the through hole 4*a* upon which image density greatly depends, thickness of the insulating layer 4 is determined by strict control. When the insulating layer 4 is formed on the inner circumferential face of the surface electrode 2, three coating methods are available as shown in FIGS. 9, 10 and 11. One is a coating method in which the surface electrode 2 is dipped into the PMER liquid resin (positive photosensitive liquid resin "w") and then is drawn up, as shown in FIG. 9. Another is a coating method in which the positive photosensitive liquid resin "w" is allowed to drop through a trapped stage 101 as shown in FIG. 10. A third is a coating method in which the positive photosensitive liquid resin "w" is applied (drops are applied) to the inner circumferential face of the surface electrode 2 along an axial direction of the cylindrical drum and the surface electrode 2 is rotated at high speed as shown in FIG. 11. In the coating method shown in FIG. 9, since the positive photosensitive liquid resin "w" adheres to the outer circumferential face of the surface electrode 2 (metal mesh sleeve), to prevent the exposure light being intercepted at the time of making the hole, the outer circumferential face of the surface electrode 2 is coated with a cover mask 91. The coating methods shown in FIG. 10 and FIG. 11 are suitable in a case where an aperture ratio of the surface electrode 2 (fine hole 2*a*) is low, that is, where the positive photosensitive liquid resin "w" entering the fine holes 2*a* at the time of the coating would not be easily leaked. However, in these two methods, even if the cover mask 91 described above is not used, the outer circumferential face of the surface electrode 2 would not be stained with the positive photosensitive liquid resin "w" at the time of the coating.

In the coating method shown in FIG. 11 in particular, by applying a centrifugal force to the positive photosensitive liquid resin "w", the insulating layer 4 having a more uniform thickness can be formed on the inner circumferential face of the surface electrode 2. In order to obtain a desired thickness of the insulating layer 4, it is necessary to give strict control to the viscosity and amount of the positive photosensitive liquid resin "w" and number of revolutions of the surface electrode 2. At this point, if, due to high aperture rate of the surface electrode 2, low resolution application and low viscosity of the positive photosensitive liquid resin "w", the surface electrode 2 has to be rotated at high speed, an inside portion of the fine hole 2*a* is intercepted by the positive photosensitive liquid rasin "w". However, if amount of the liquid is not so large as to flow around the outer circumferential face, the positive photosensitive liquid resin "w" stayed in the fine hole 2*a* at time of exposure and development is dissolved and removed. Moreover, the coating method shown in FIG. 11, since it allows consecutive baking process while coating is being performed, is very suitable in the case of mass production. The baking process is performed in a manner that the substance to be baked is kept in a thermostatic oven at 100° C. for 15 minutes after the coating of the positive photosensitive liquid resin "w" or at the time of coating. This allows a solvent to be volatilized not only from the surface (outer circumferential face) of the surface electrode 2 but also from the inside of the fine hole 2*a*, thus enabling formation of the insulating layer 4 being from residual solvents on the inner circumferential face of the surface electrode 2 within a short time.

Hole-Making in Insulating Layer

Figure 7B:
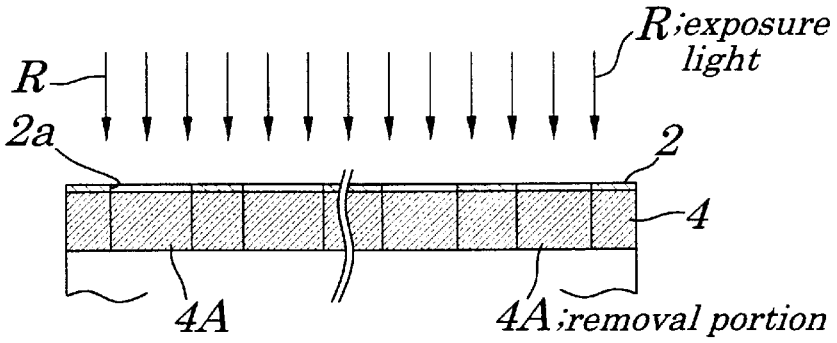
Figure 12:
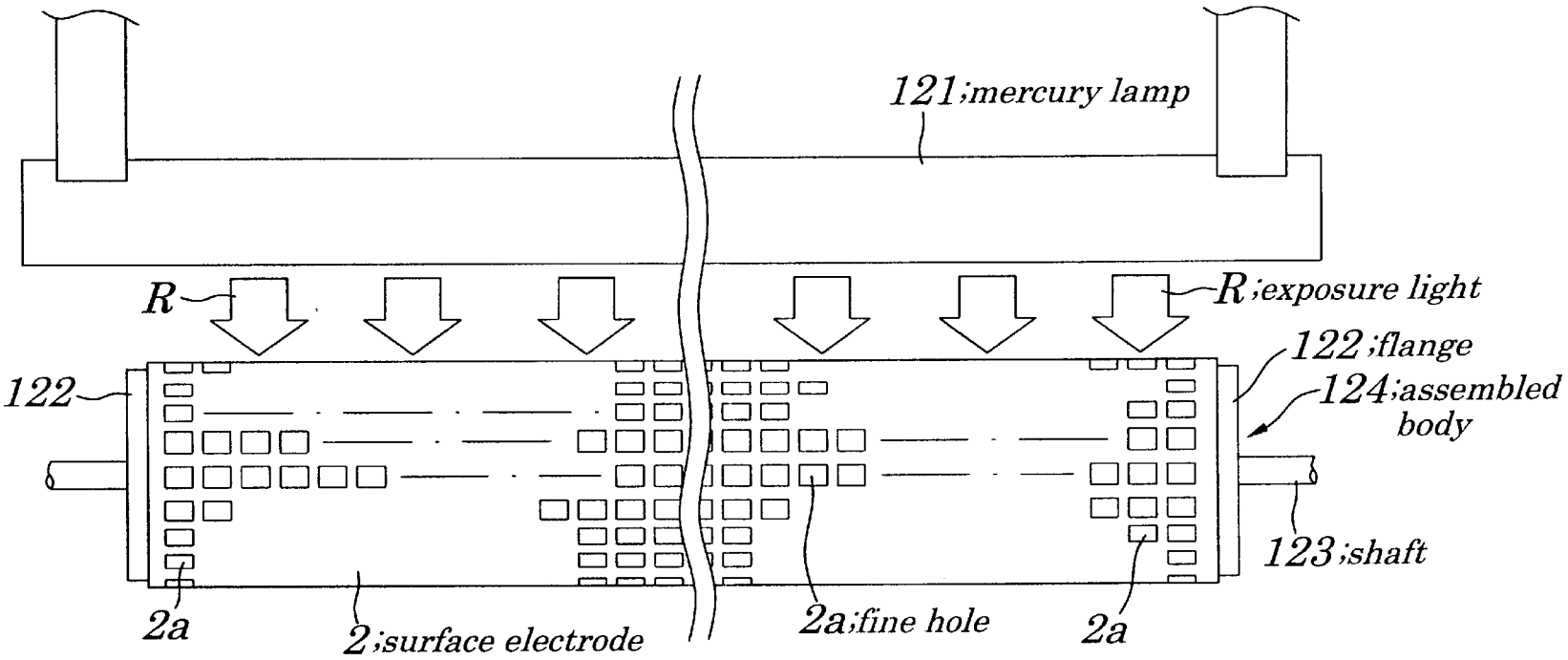
FIG. 12 is a side view explaining a method for exposure on the insulating body in the porous photosensitive body according to the embodiment of the present invention.
Figure 13:
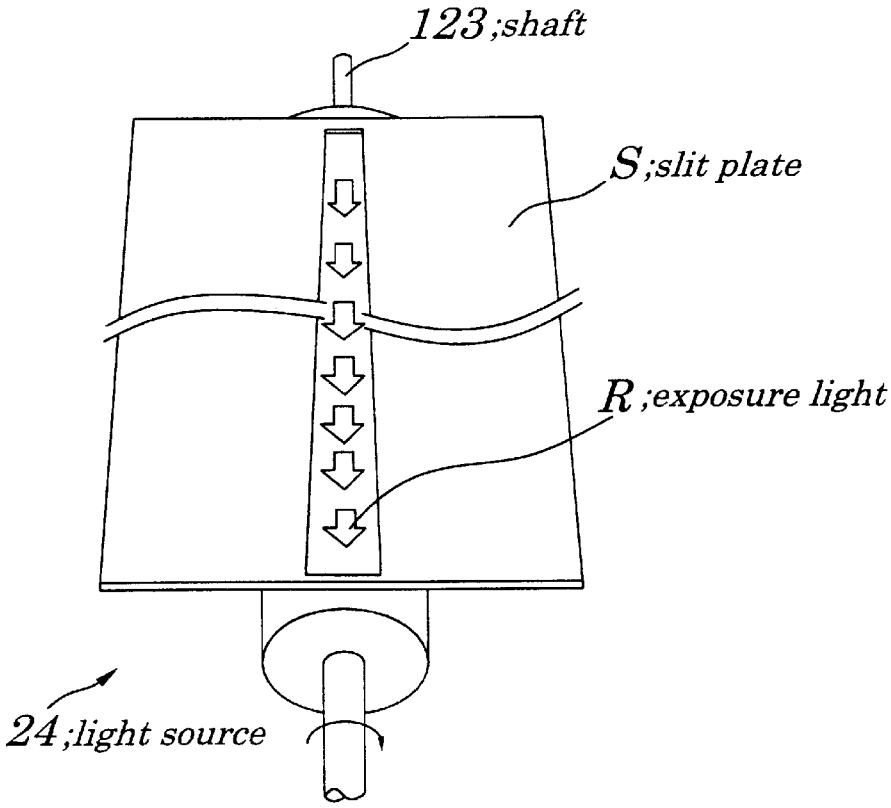
FIG. 13 is a perspective view explaining a method for exposure on the insulating body in the porous photosensitive body according to the embodiment of the present invention.

As shown in FIG. 7B, the insulating layer 4 is exposed to exposure light R irradiated from the outer circumferential side of the surface electrode 2. That is, the exposure light R having the highest sensitivity to an i-line with a wavelength of 365 nm emitted from a high pressure mercury lamp (straight pipe lamp) is irradiated on a removal portion 4A of the insulating layer 4. The exposure light R may be simultaneously emitted from a large number of the mercury lamps (straight pipe lamps) each having an axial line being parallel to that the surface electrode 2 disposed at equal intervals in the circumferential direction. Moreover, as shown in FIG. 12, the exposure light R emitted from a mercury lamp 121 having an axial line being parallel to that of the surface electrode 2 mounted in a fixed manner may be irradiated on an assembled body 124 made of the surface electrode 2 provided with a flange 122 and a shaft 123 while being rotated. In this method, since it is necessary to make uniform a cumulative amount of radiation (products of luminous intensity and irradiation time) on the positive photosensitive resin (insulating layer 4) at each portion and to cause rays of the exposure light R entering each of the removal portions 4A to be parallel to each other and to be incident in each of the portions 4A vertically to the outer circumferential face, the exposure is performed by using a slit plate S which serves to prevent the exposure light R from flowing around, as shown in FIG. 13.

Figure 14:
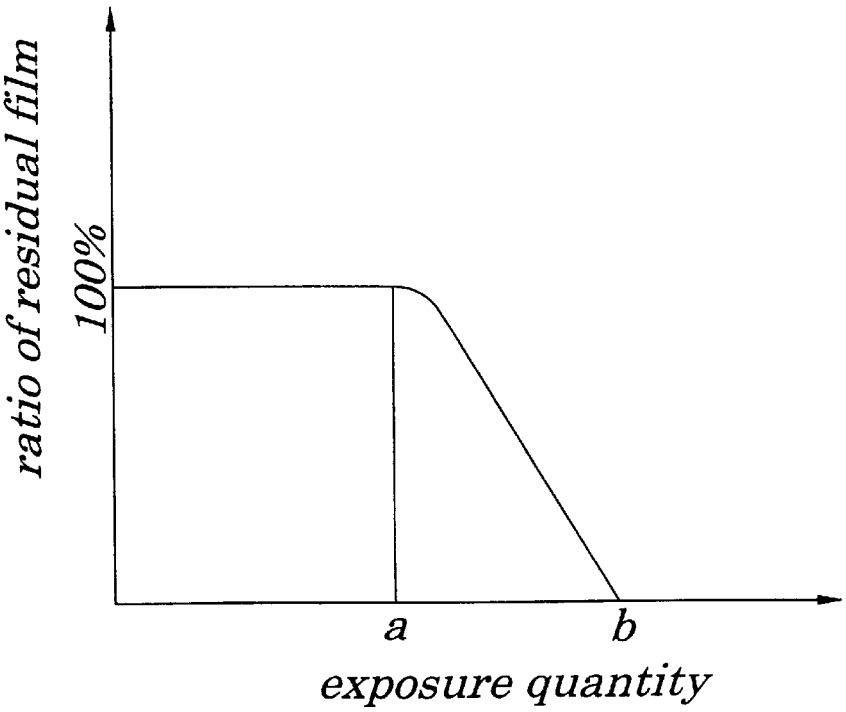
FIG. 14 is a graph showing a relationship between an exposure quantity and a ratio of residual film observed when the exposure is performed on the insulating layer of the porous photosensitive body according to the embodiment of the present invention.

As is apparent from FIG. 14, if the amount of exposure light irradiated on the positive photosensitive resin exceeds a specified level (shown as "a" point in FIG. 14), as the exposure quantity increases, a dissolution strength of a liquid developer becomes high rapidly and if the amount of the exposure light exceeds the level that minimizes a ratio of residual film (a ratio of amount of non-dissolved resins to that of liquid developer) is irradiated on the positive photosensitive resin, the positive photosensitive resin is dissolved in the liquid developer at a maximum. This means that a problem can be solved only if the exposure light whose amount exceeds the level at "b" point in FIG. 14 at a time of the exposure is irradiated on the positive photosensitive resin. This enables easy control of the exposure light and mass production of the porous photosensitive body. Furthermore, unlike in a case of the conventional proximity exposure method, the metal mesh sleeve functioning as a mask at the time of the exposure is firmly and closely adhered to the positive photosensitive resin, thus providing an excellent resolution, and since a conventional work of peeling the mask off that had been required after the completion of the exposure is not required, reduction of a number of processes and avoidance of defects of the hole are made possible.

Figure 7C:
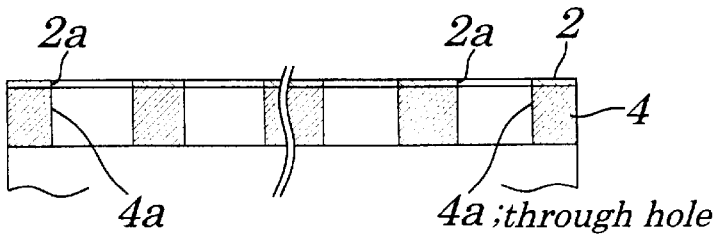
Figure 15A:
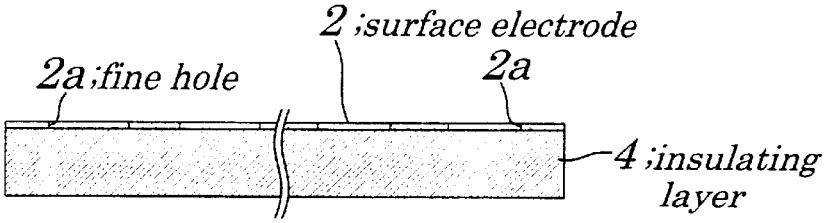
FIGS. 15A and 15B are cross-sectional views explaining one method of making holes in the porous photosensitive body according to the embodiment of the present invention.
Figure 15B:
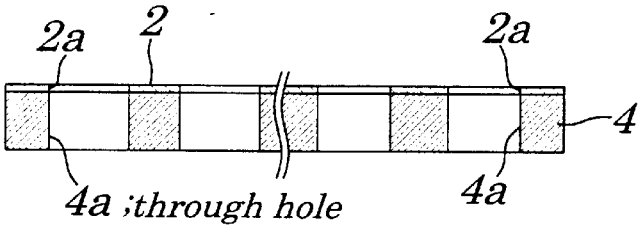
Figure 16A:
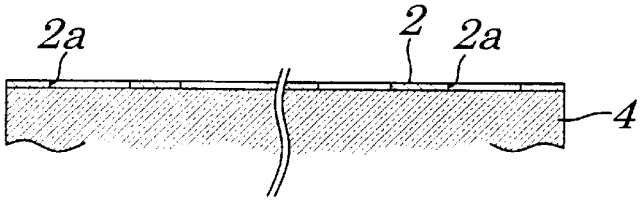
FIGS. 16A to 16C are cross-sectional views explaining another method of making holes in the porous photosensitive body according to the embodiment of the present invention.
Figure 16B:
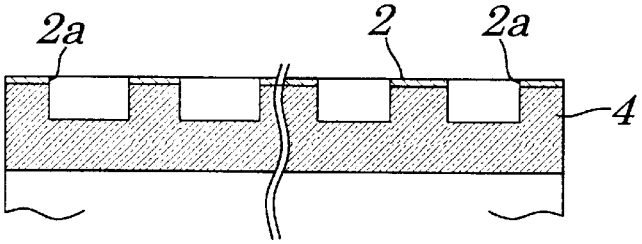
Figure 16C:
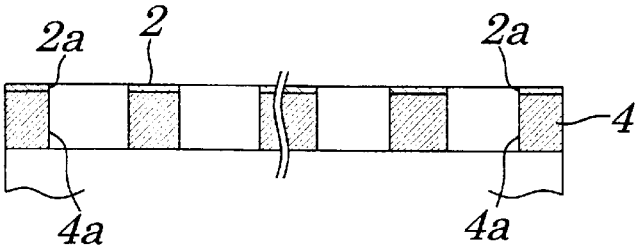
Figure 17A:
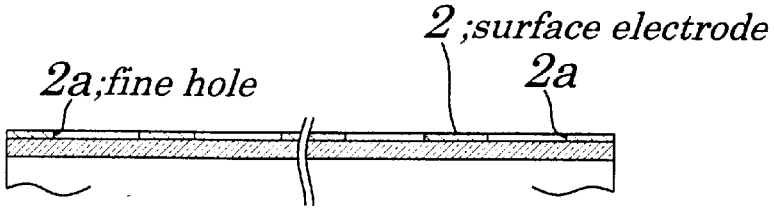
FIGS. 17A to 17D are cross-sectional views explaining a third method of making holes in the porous photosensitive body according to the embodiment of the present invention.
Figure 17B:
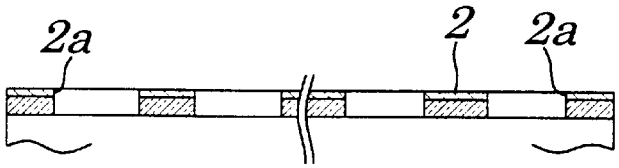
Figure 17C:
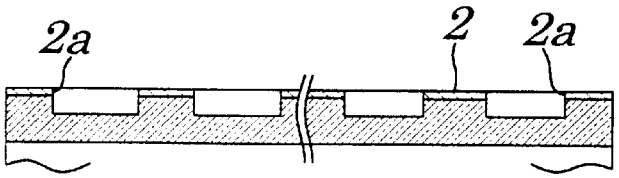
Figure 17D:
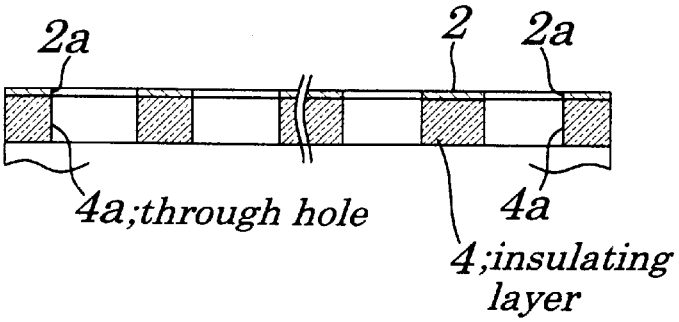

As shown in FIGS. 7C, 15A and 15B, the through hole 4*a* is made by dissolving (developing) the removal portion 4A of the insulating layer 4. In this process, the insulating layer 4 having the surface electrode 2 may be dipped into the liquid developer or the liquid developer may be sprayed by high pressure jetting from the outer circumferential face of the surface electrode 2 and from the inner circumferential face of the insulating layer 4. At this point, if the positive photosensitive resin does not dissolve at one time, as shown in FIGS. 16A to 16C, the exposure and developing processes may be repeated serially several times. Also, as shown in FIGS. 17A to 17D, the coating, exposing and developing processes may be repeated serially several times. Any one of these methods for making holes is selected based on optical transmittance of the positive photosensitive resin, film formation property, solubility of the positive photosensitive resin in the liquid developer or a like. That is, if a sufficient thickness of the positive photosensitive resin cannot be ensured due to its deficiencies in film formation property, a method shown in FIGS. 17A to 17B may be used, while, even though the photosensitive resin has excellent optical transmittance and good film formation property, if its developing property at the irradiated portion is not good, a method shown in FIGS. 16A to 16C may be used. Also, a post-baking processing may be performed after completion of development. Then, the liquid developer adhered to the surface of the insulating layer 4 is removed by using pure water and is dried.

Formation of Photo-conductive Layer and Translucent Conductive Layer

Figure 7D:
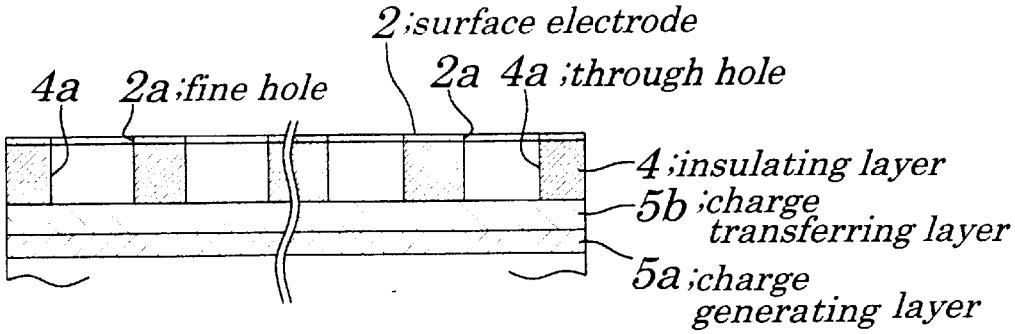
Figure 18A:
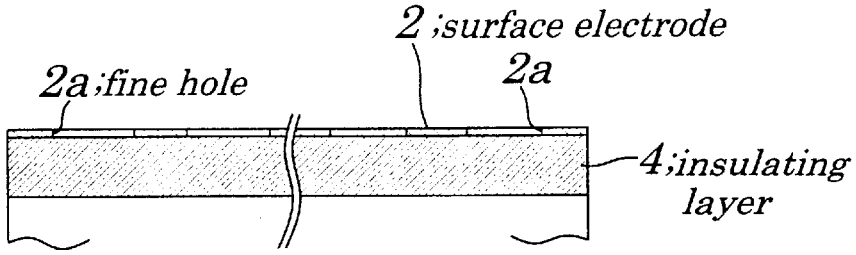
FIGS. 18A to 18C are cross-sectional views explaining a fourth method of making holes in the porous photosensitive body according to the embodiment of the present invention.
Figure 18B:
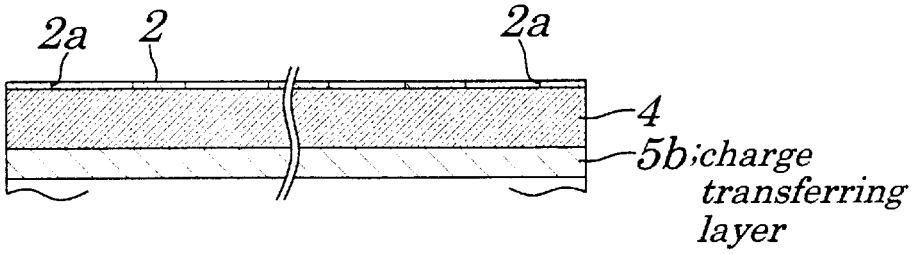
Figure 18C:
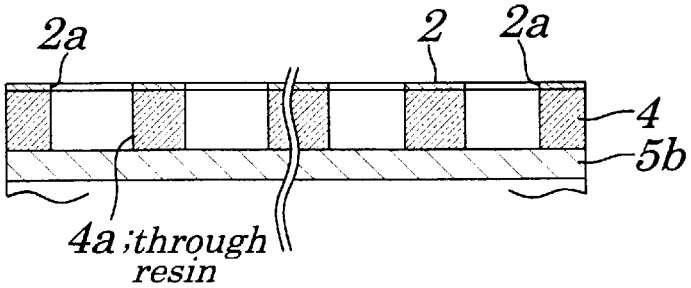

First, as shown in FIG. 7D, the charge generating layer 5*a* and the charge transferring layer 5*b* are stacked, in order, on the inner circumferential face of the insulating layer. In the embodiment, the charge generating layer 5*a* made of, for example, n-type titanylphthalocyanine and polyvinyl butyral, with a thickness of 0.05 $\mu$m to 1 $\mu$m, is used. The charge transferring layer 5*b* containing 20% to 40% by weight of a charge transferring material consisting of polycarbonate used as a binder resin dissolved in a solvent such as tetrahydrofuran, for example, a charge transferring material disclosed in Japanese Patent Application Laid-open No. Hei7-168376, with a thickness of 1 $\mu$m to 30 $\mu$m, is used in this embodiment. However, formation of the charge transferring layer 5*b* on the inner circumferential face of the insulating layer 4 cannot be made by using the coating method shown in FIG. 11. That is, when the coating liquid of the charge transferring layer 5*b* is applied to the inner circumferential face of the insulating layer 4, if the viscosity of the coating liquid is low, there is a risk that the through hole 4*a* is intercepted by a centrifugal force at the time of the coating (rotating). For this reason, the coating method shown in FIG. 9 is used for the formation of the charge transferring layer 5*b* on the inner circumferential face of the insulating layer 4. If the through hole 4*a* of the insulating layer 4 is intercepted due to low ratio of contents of solid matter in the coating liquid, the hole-making process (developing process) is not carried out before the formation of the charge transferring layer 5*b*. In this case, as shown in FIGS. 18A to 18C, the hole is made after the charge transferring layer 5*b* is formed on the insulating layer 4 on the surface electrode 2 or after the charge transferring layer 5*b* and charge generating layer 5*a* are formed in order. Moreover, the formation of the charge generating layer 5*a* on the inner circumferential face of the charge transferring layer 5*b* is performed, after the coating of the charge transferring layer 5*b* is completed, by using the coating methods shown in FIGS. 9 to 11.

Additionally, a float electrode as disclosed in Japanese Patent Application Laid-open No. Hei9-204092 may be mounted between the insulating layer 4 and photo-conductive layer 5 (charge transferring layer 5*b*).

In the embodiment described above, the charge transferring layer 5*b* and charge generating layer 5*a* are stacked, in order, on the inner circumferential face of the insulating layer 4, however, the present invention is not limited to this. A reversely-stacked type photo-conductive layer 5 in which the charge generating layer 5*a* and charge transferring layer 5*b* are stacked in order may be used as well. Moreover, not only a function-separated type photo-conductive layer 5 in which both layers 5*a* and 5*b* are stacked separately but also a monolayer-structured photo-conductive layer obtained by dispersing a charge transferring material and charge generating material in an insulating polymer may be used.

Figure 7E:
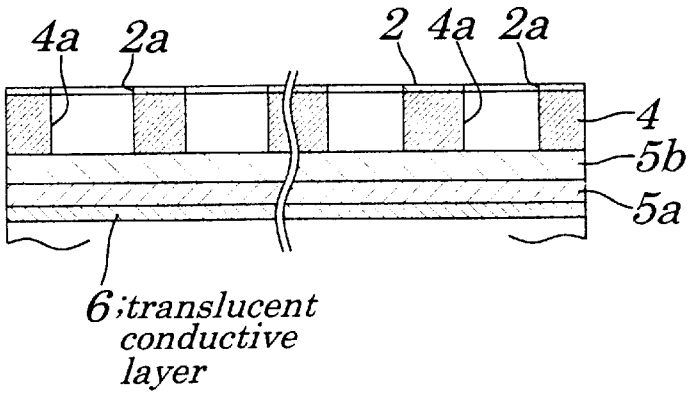

Next, as shown in FIG. 7E, on the inner circumferential face of the charge generating layer 5*a* in the photo-conductive layer 5 is formed the translucent conductive layer 6. In this process, though the translucent conductive layer 6 can be formed by a vacuum evaporation method or sputtering method using aluminum, since these methods cause firm adhesion of metal grains to the photo-conductive layer 5 to be difficult and film formation property and productivity to be reduced, it is formed preferably by coating with the conductive coating liquid made of transparent materials such as ITO or $SnO_2$ by coating methods shown in FIGS. 9 to 11 (preferably by the method shown in FIG. 11) and then by being dried.

Moreover, in order to improve adhesive strength between layers and to prevent invasion of charges, an underlying layer composed of alcohol-soluble nylon resins, photo-curing resins, thermosetting resins or a like may be mounted between the translucent conductive layer 6 and the charge generating layer 5*a*. These processes enable reliable formation of the porous photosensitive body 1.

Figure 7F:
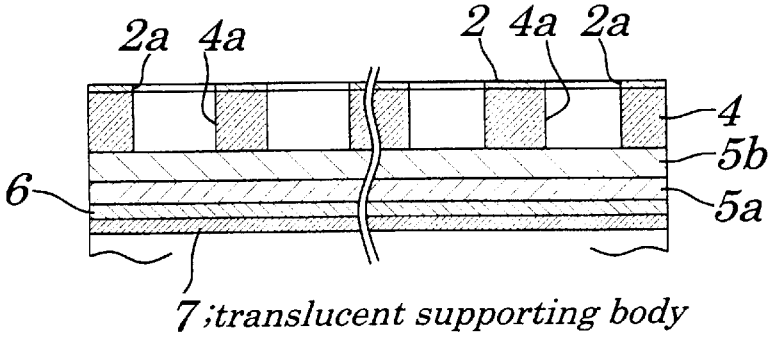
Figure 19:
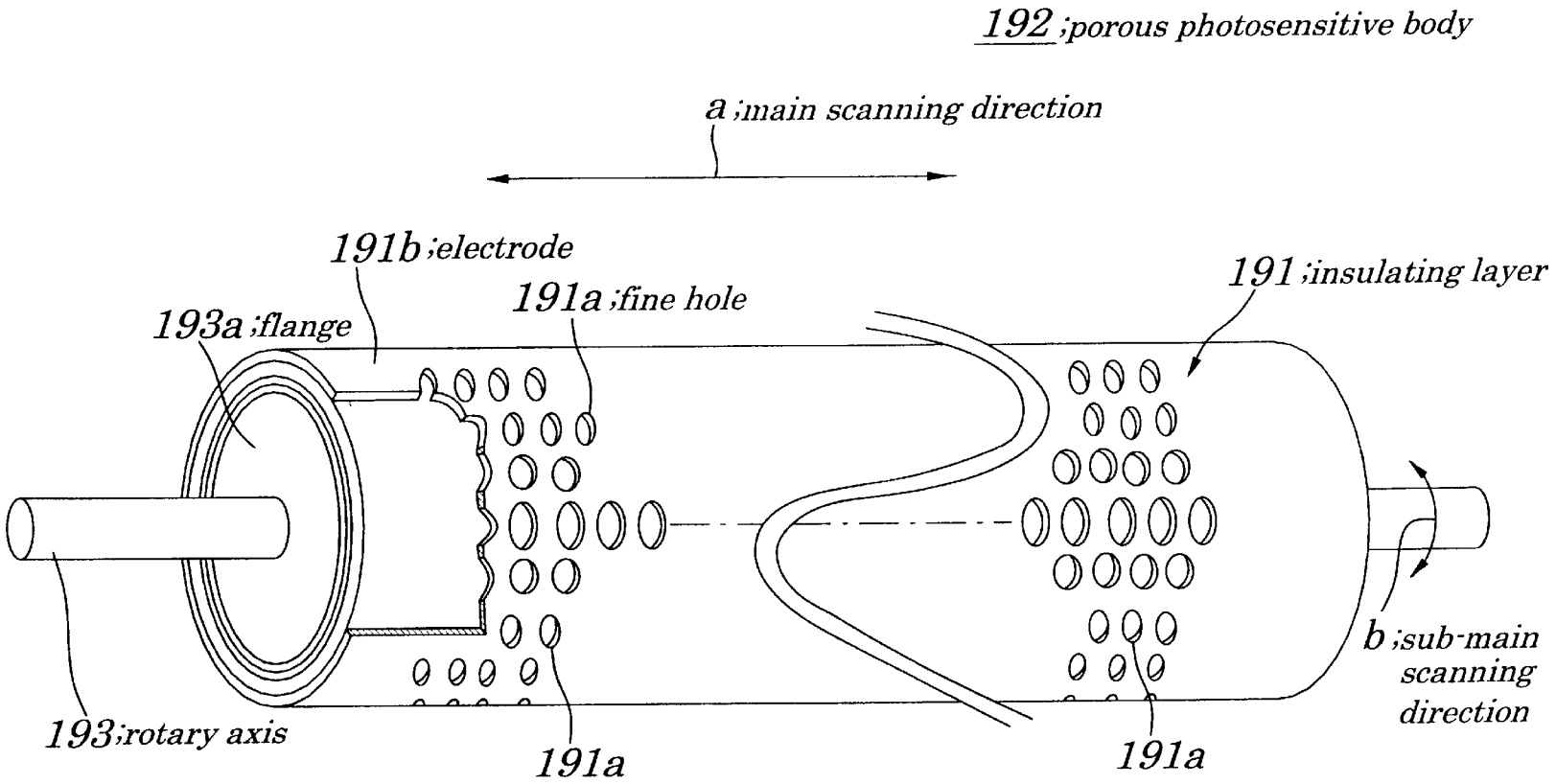
FIG.19 (PRIOR ART)
FIG. 19 is a perspective view showing configurations of a conventional porous photosensitive body.
Figure 20:
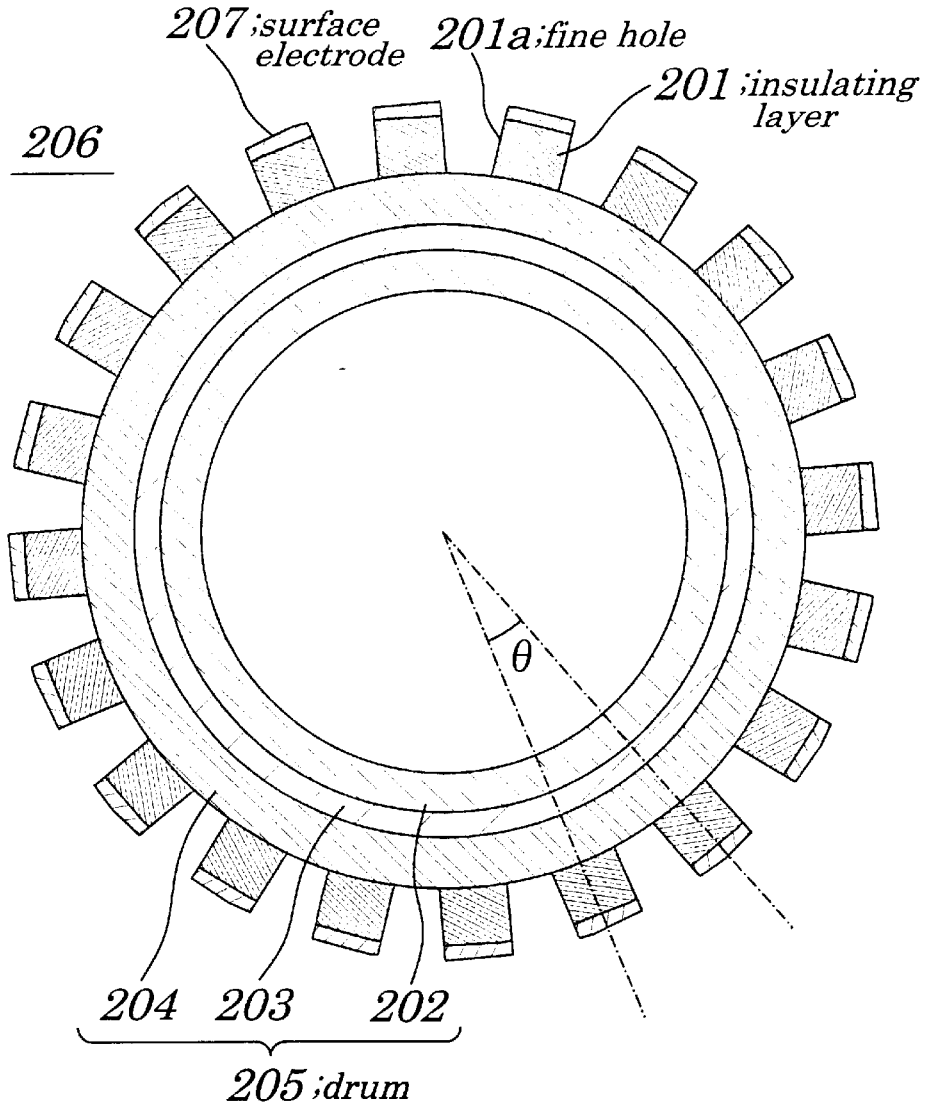
FIG.20 (PRIOR ART)
FIG. 20 is a cross-sectional view showing the conventional porous photosensitive body.
Figure 21:
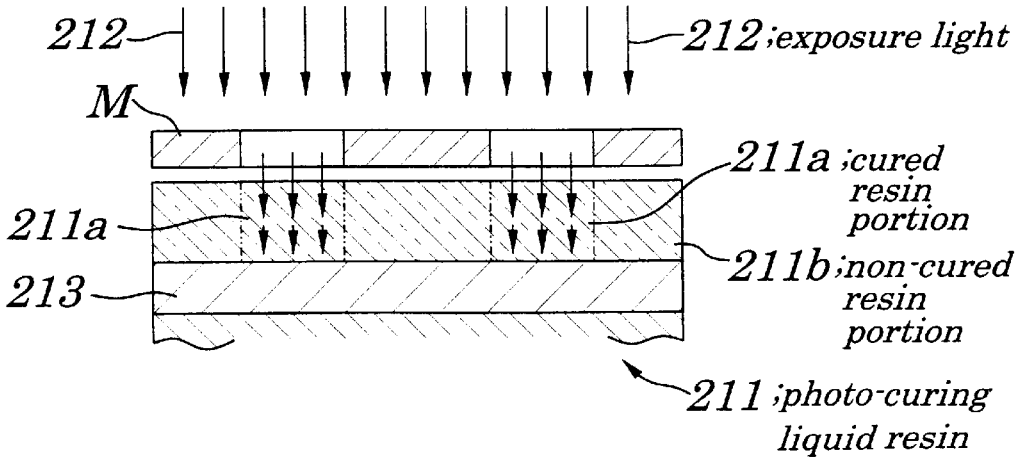
FIG.21 (PRIOR ART)
FIG. 21 is a cross-sectional view explaining a method of exposure on an insulating layer of the conventional porous photosensitive body.
Figure 22:
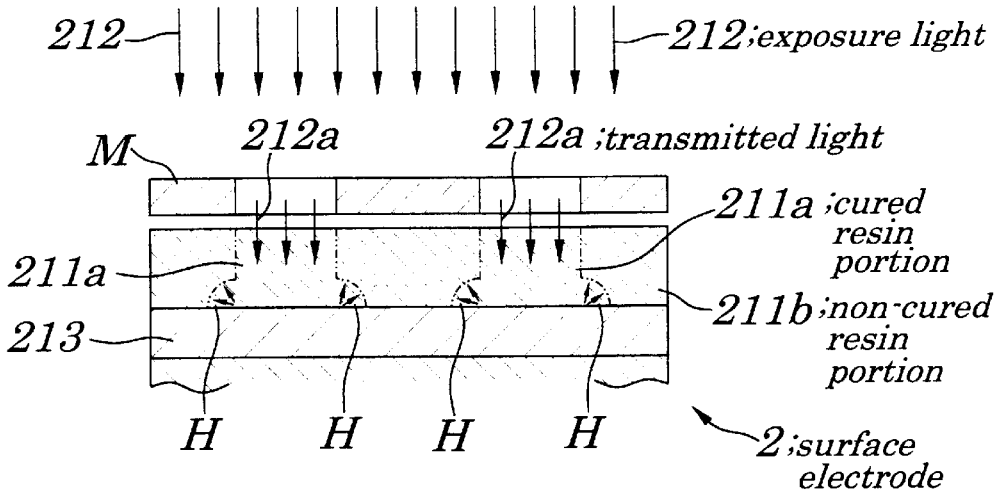
FIG.22 (PRIOR ART)
FIG. 22 is a cross-sectional view explaining a defective example of the exposure on the insulating layer of the conventional porous photosensitive body.
Figure 23:
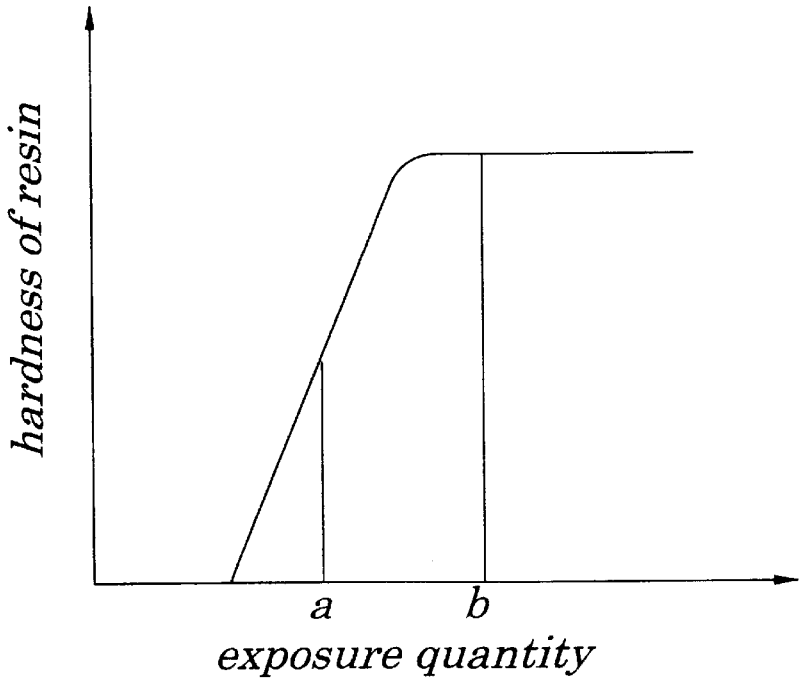
FIG.23 (PRIOR ART)
FIG. 23 is a graph showing a relationship between an exposure quantity and hardness of a resin when an exposure light is irradiated on the insulating layer of the conventional porous photosensitive body.
Figure 24:
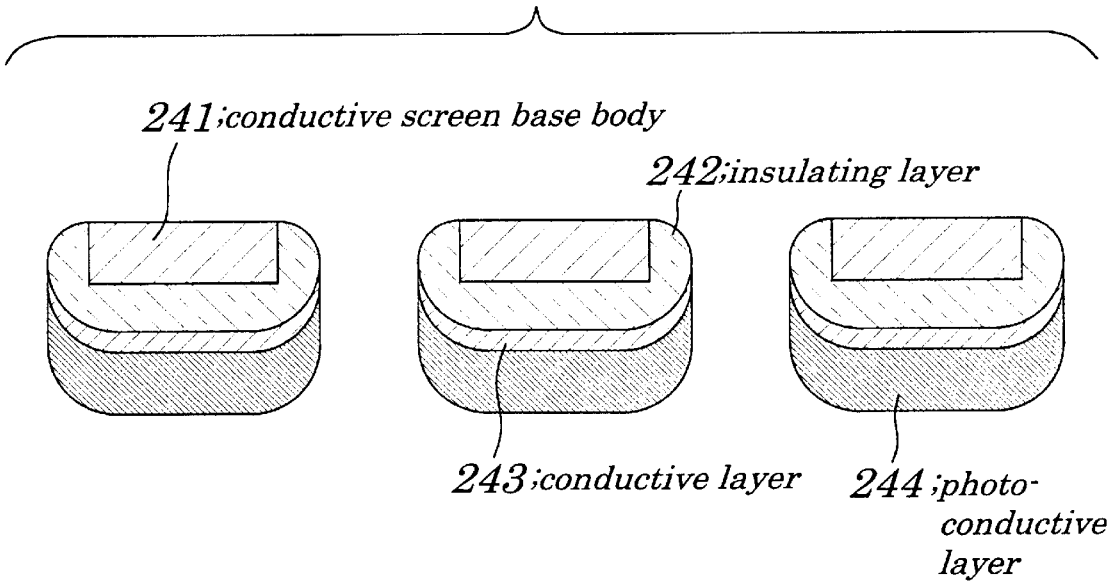
FIG.24 (PRIOR ART)
FIG. 24 is a cross-sectional view explaining a method for fabricating the conventional porous photosensitive body.

After these processes are completed, due to the thin surface electrode 2 in particular, if reinforcements such as a flange 193*a* as shown in FIG. 19 can not provide enough mechanical strength to support the porous photosensitive body 1, a translucent supporting body 7 may be formed on the inner circumferential face of the translucent conductive layer 6 as shown in FIG. 7F. For formation of the translucent supporting body 7, methods are available in which thermoplastic resin is poured into a die and then solidified or in which a thermosetting resin or photo-curing resin is first stacked and then the stacked resin is cured and polymerized. As materials for the translucent supporting body 7, polycarbonate (PC), polymethyl methacrylate (PMMA) or a like can be used as the thermoplastic resin having transparency while diethylene glycol bisallyl carbonate, sulfur-containing urethane resins or a like can be used as the thermosetting resin. Though it is most desirous to use photo-curing resins for prevention of occurrence of breakage in the translucent conductive layer 6, so long as a strong translucent conductive layer 6 can be obtained by proper selection of resin, other resins may be employed as well. In the embodiment, since the resin and the method of same that would not cause damage to the translucent conductive layer 6 formed in the previous process are required, thermosetting or photo-curing resin containing no organic solvent is employed. In the method in which the thermosetting resin is used, to prevent occurrence of optical distortion, the thermosetting resin is heated at 30° to 120° C. for 15 hours to 30 hours for polymerization. When the photo-curing resins are used, for example, epoxy acrylate, urethane acrylate, polyester acrylate or a like, which is used as base monomers, is mixed with monofunctional acrylate or polyfunctional acrylate, which is used as diluted monomers, and additionally with photoinitiation agents and the resulting mixed products are cured for about 20 minutes including light irradiating time (3 minutes).

The thickness of the translucent supporting body 7 is adjusted so as to be a predetermined (about 3 mm) by the coating method shown in FIG. 11. So long as the translucent supporting body 7 has surface smoothness that would not scatter exposure light from a light source 24 (FIG. 13) and transparency that could cause light to reach the charge transferring layer 5*b*, it is not necessary for the translucent supporting body 7 to have dimensional accuracy being so high as is required in conventional technologies.

In the embodiment described above, the through hole 4*a* is made on the inner circumferential face of the surface electrode 2 after the insulating layer 4 is stacked or after the insulating layer 4 and the photo-conductive layer 5 are stacked in order, however, the present invention is not limited to that. That is, the through hole 4*a* may be made after the insulating layer 4, photo-conductive layer 5 and translucent conductive layer 6 are stacked in order. In this method, it is possible to select the best suitable resin material according to each of the methods, thus serving to improve freedom to choose the resin material.

As described above, according to the porous photosensitive body of the present invention, since the supporting cylinder is made of the metal jointless cylinder having the large number of fine holes which are aligned at equal intervals both in the circumferential direction and in the direction of the axial line of the cylindrical drum and are opened on the inner and outer circumferential faces of the metal jointless cylinder and since the insulating layer is provided with the through hole which communicates with each of the fine holes, the following effects can be achieved:

(1) Since the surface electrode can serve as the supporting body at time of manufacturing the porous photosensitive body, highly accurate working of the translucent supporting body that had been required is not required, thus enabling mass production of the porous photosensitive body.

(2) An angle detecting device and position detecting device that had been required to obtain high resolution is not required, thus enabling cost to be reduced.

(3) Since the fine holes on the insulating layer are formed by irradiating the exposure light on the insulating layer on the inner circumferential face of the surface electrode from the outer circumferential face side for development, halation that had occurred does not occur, thus enabling simple control at time of exposure and improving production efficiency.

(4) Since the surface electrode serving as the mask is firmly adhered to the insulating layer, unlike in a case of a conventional technology, the exposure light is not refracted at the time of exposure, thus achieving an excellent degree of image-formation.

(5) Since the surface electrode having uniform and sufficient thickness and being free from defects can be obtained, thus providing good conductivity, completely preventing occurrence of breakage and improving reliability for use.

It is apparent that the present invention is not limited to the above embodiments but may be changed and modified without departing from the scope and spirit of the invention.

Finally, the present application claims the priority based on Japanese Patent Application No. Hei11-245754 filed Aug. 31, 1999, which is herein incorporated by reference.

What is claimed is:

1. A porous photosensitive body constructed by stacking, in order, a photosensitive resin layer serving as an insulating layer, a photoconductive layer and a translucent conductive layer on an inner circumferential face of a metal jointless cylindrical drum wherein said metal jointless cylindrical drug is formed by using an electroplating method and has a large number of first fine through holes which are aligned at equal intervals both in a circumferential direction of said metal jointless cylindrical drum and in a direction of an axial line of said metal jointless cylindrical drum; and wherein on said photosensitive resin layer formed are a large number of second find through holes respectively communicating with each of said first fin through holes formed on said metal jointless cylindrical drum, by irradiating exposure light on said photosensitive resin layer through said metal jointless cylindrical drum to dissolve irradiated portion's, whereas a large number of fine holes is not formed on said photoconductive layer.

2. The porous photosensitive body according to claim 1, wherein said metal jointless cylindrical drum has a Vickers hardness of 50 to 1500.

3. The porous photosensitive body according to claim 1, wherein said metal jointless cylindrical drum is made of a material containing nickel.

4. The porous photosensitive body according to claim 1, wherein said photosensitive resin is composed of a positive type photoresist.

5. A method for manufacturing a porous photosensitive body constructed by stacking, in order, a photosensitive resin layer serving as an insulating layer, a photoconductive layer and a translucent conductive layer on an inner circumferential face of a metal jointless cylindrical drum comprising the steps of:

forming by using an electroplating method, said metal jointless cylindrical drum having a large number of first fine through holes which are aligned at equal intervals both in a circumferential direction of said metal jointless cylindrical drum and in a direction of an axial liner of said metal jointless cylindrical drum; and forming said photosensitive layer on said inner circumferential face of said metal jointless cylindrical drum, and then forming a large number of second fine through holes respectively communicating with each of said first fine through holes formed on said metal jointless cylindrical drum, by irradiating exposure light on said photosensitive resin layer through said metal jointless cylindrical drum to dissolve irradiated portions, before said photoconductive layer is stacked, whereas a large number of fine holes is not formed on said photoconductive layer.

6. A method for manufacturing a porous photosensitive body constructed by stacking, in order, a photosensitive resin layer serving as an insulating layer, a photoconductive layer and a translucent conductive layer on an inner circumferential face of a metal jointless cylindrical drum comprising the steps of:

forming by using an electroplating method, said metal jointless cylindrical drum having a large number of first fine through holes which are aligned at equal intervals both in a circumferential direction of said metal jointless cylindrical drum and in a direction of an axial line of said metal jointless cylindrical drum; and forming said photosensitive resin layer on said inner circumferential face of said metal jointless cylindrical drum, and then forming a large number of second fine through holes respectively communicating with each of said first fine through holes formed on said metal jointless cylindrical drum, by irradiating exposure light on said photosensitive resin layer through said metal jointless cylindrical drum to dissolve irradiated portions, after said photoconductive layer is stacked, whereas a large number of fine holes is not formed on said photoconductive layer.

7. A method for manufacturing a porous photosensitive body constructed by stacking, in order, a photosensitive resin layer serving as an insulating layer, a photoconductive layer and a translucent conductive layer on an inner circumferential face of a metal jointless cylindrical drum comprising the steps of:

forming by using an electroplating method, said metal jointless cylindrical drum having a large number of first fine through holes which are aligned at equal intervals both in a circumferential direction of said metal jointless cylindrical drum and in a direction of an axial line of said metal jointless cylindrical drum; and forming said photosensitive resin layer on said inner circumferential face of said metal jointless cylindrical drum, and then forming a large number of second fine through holes respectively communicating with each of said first fine through holes formed on said metal jointless cylindrical drum by irradiating exposure light on said photosensitive resin layer through said metal jointless cylindrical drum to dissolve irradiated portions, after said translucent conductive layer is stacked, whereas a large number of fine holes is not formed on said photoconductive layer.

8. The method for manufacturing the porous photosensitive body according to claim 5, wherein said exposure light from a mercury lamp is irradiated on said insulating layer.

9. The method for manufacturing the porous photosensitive body according to of claim 5, wherein said irradiated portion is dissolved by dipping a stacked body formed by stacking said insulating layer on an inner circumferential face of said supporting cylinder, into a solvent.

10. The method for manufacturing the porous photosensitive body according to claim 5, wherein said irradiated portion is dissolved by spraying a solvent on said insulating layer.

11. The method for manufacturing the porous photosensitive body according to Clam 5, wherein said insulating layer or said photo-conductive layer is stacked by using a process of dipping each body to be stacked into a corresponding resin material.

12. The method for manufacturing the porous photosensitive body according to claim 5, wherein said insulating layer or said photo-conductive layer is stacked by using process of applying a corresponding resin material to each body to be stacked and then rotating said each body to be stacked.

13. The method for manufacturing the porous photosensitive body according to claim 12, wherein baking treatment is performed on said each resin material when said insulating layer or said photo-conductive layer is stacked.

14. The method for manufacturing the porous photosensitive body according to claim 13, wherein a surface of said supporting cylinder is coated when said insulating layer or said photo-conductive layer is stacked.

15. The method for manufacturing the porous photosensitive body according to claim 14, wherein said translucent conductive layer is stacked by using process of applying and curing a liquid material to an inner circumferential face of said photo-conductive layer.

16. The method for manufacturing the porous photosensitive body according to claim 6, wherein said supporting cylinder is formed by an electroplating method.

17. The method for manufacturing the porous photosensitive body according to claim 6, wherein said insulating layer is composed of a photosensitive resin and said fine holes are made by irradiating exposure light on said photosensitive resin to dissolve an irradiated portion.

18. The method for manufacturing the porous photosensitive body according to claim 17, wherein said exposure light is irradiated on said insulating layer through said supporting cylinder.

19. The method for manufacturing the porous photosensitive body according to claim 17, wherein said exposure light from a mercury lamp is irradiated on said insulating layer.

20. The method for manufacturing the porous photosensitive body according to of claim 17, wherein said irradiated portion is dissolved by dipping a stacked body formed by stacking said insulating layer on an inner circumferential face of said supporting cylinder, into a solvent.

21. The method for manufacturing the porous photosensitive body according to claim 17, wherein said irradiated portion is dissolved by spraying a solvent on said insulating layer.

22. The method for manufacturing the porous photosensitive body according to claim 17, wherein said insulating layer or said photo-conductive layer is stacked by using a process of dipping each body to be stacked into a corresponding resin material.

23. The method for manufacturing the porous photosensitive body according to claim 6, wherein said insulating layer or said photo-conductive layer is stacked by using process of applying a corresponding resin material to each body to be stacked and then rotating said each body to be stacked.

24. The method for manufacturing the porous photosensitive body according to claim 23, wherein baking treatment is performed on said each resin material when said insulating layer or said photo-conductive layer is stacked.

25. The method for manufacturing the porous photosensitive body according to claim 24, wherein a surface of said supporting cylinder is coated when said insulating layer or said photo-conductive layer is stacked.

26. The method for manufacturing the porous photosensitive body according to claim 25, wherein said translucent conductive layer is stacked by using process of applying and curing a liquid material to an inner circumferential face of said photo-conductive layer.

27. The method for manufacturing the porous photosensitive body according to claim 7, wherein said supporting cylinder is formed by an electroplating method.

28. The method for manufacturing the porous photosensitive body according to claim 7, wherein said insulating layer is composed of a photosensitive resin and said fine holes are made by irradiating exposure light on said photosensitive resin to dissolve an irradiated portion.

29. The method for manufacturing the porous photosensitive body according to claim 28, wherein said exposure light is irradiated on said insulating layer through said supporting cylinder.

30. The method for manufacturing the porous photosensitive body according to claim 28, wherein said exposure light from a mercury lamp is irradiated on said insulating layer.

31. The method for manufacturing the porous photosensitive body according to of claim 28, wherein said irradiated portion is dissolved by dipping a stacked body formed by stacking said insulating layer on an inner circumferential face of said supporting cylinder, into a solvent.

32. The method for manufacturing the porous photosensitive body according to claim 28, wherein said irradiated portion is dissolved by spraying a solvent on said insulating layer.

33. The method for manufacturing the porous photosensitive body according to claim 28, wherein said insulating layer or said photo-conductive layer is stacked by using a process of dipping each body to be stacked into a corresponding resin material.

34. The method for manufacturing the porous photosensitive body according to claim 7, wherein said insulating layer or said photo-conductive layer is stacked by using process of applying a corresponding resin material to each body to be stacked and then rotating said each body to be stacked.

35. The method for manufacturing the porous photosensitive body according to claim 34, wherein baking treatment is performed on said each resin material when said insulating layer or said photo-conductive layer is stacked.

36. The method for manufacturing the porous photosensitive body according to claim 35, wherein a surface of said supporting cylinder is coated when said insulating layer or said photo-conductive layer is stacked.

37. The method for manufacturing the porous photosensitive body according to claim 36, wherein said translucent conductive layer is stacked by using process of applying and curing a liquid material to an inner circumferential face of said photo-conductive layer.

* * * * *